US007737929B2

(12) United States Patent
Itou et al.

(10) Patent No.: US 7,737,929 B2
(45) Date of Patent: Jun. 15, 2010

(54) DISPLAY DEVICE HAVING LOW VOLTAGE DIFFERENTIAL SIGNAL LINES OVERLAPPING DRIVE CIRCUITS

(75) Inventors: Shigeru Itou, Mobara (JP); Shuuichirou Matsumoto, Mobara (JP); Yukihide Ode, Mobara (JP); Hidetoshi Kida, Mobara (JP); Kouichi Kotera, Kokubunji (JP); Gou Yamamoto, Mobara (JP)

(73) Assignee: Hitachi Displays, Ltd., Mobara-shi (JP)

( * ) Notice: Subject to any disclaimer, the term of this patent is extended or adjusted under 35 U.S.C. 154(b) by 1029 days.

(21) Appl. No.: 10/819,187

(22) Filed: Apr. 7, 2004

(65) Prior Publication Data

US 2004/0212578 A1 Oct. 28, 2004

(30) Foreign Application Priority Data

Apr. 25, 2003 (JP) ..... 2003-120891

(51) Int. Cl.
*G09G 3/36* (2006.01)

(52) U.S. Cl. ..... 345/87; 345/100

(58) Field of Classification Search ..... 345/204, 345/690, 691, 205, 206, 87–104, 211
See application file for complete search history.

(56) References Cited

U.S. PATENT DOCUMENTS 5,620,922 A * 4/1997 Yoshida et al. ..... 438/210
6,480,180 B1 * 11/2002 Moon ..... 345/93
6,483,345 B1 * 11/2002 Whittaker et al. ..... 326/62
6,566,950 B1 * 5/2003 Rokhsaz ..... 330/253
6,842,164 B2 * 1/2005 Imajo et al. ..... 345/98
6,980,185 B2 * 12/2005 Kang ..... 345/87
2003/0038771 A1 * 2/2003 Sunohara ..... 345/103
2005/0146493 A1 * 7/2005 Kinjo et al. ..... 345/89

FOREIGN PATENT DOCUMENTS

JP 11-242483 9/1999
JP 2002-120891 4/2002

* cited by examiner

*Primary Examiner*—Jimmy H Nguyen
(74) *Attorney, Agent, or Firm*—Antonelli, Terry, Stout & Kraus, LLP.

(57) ABSTRACT

A display device which transmits display data to drive circuits which drive a display panel using low voltage differential signals have input circuits which are hardly influenced by noise. To transmit the low voltage differential signals under the same condition, low voltage differential signal lines are formed in a zigzag pattern so as to make the lengths of the lines equal. To reduce the influence generated by the overlapping of the zigzagged low voltage differential signal lines and the drive circuits, level shift circuits are provided to the input circuits so as to make the input signals assume a stable operation level.

7 Claims, 18 Drawing Sheets

Level Shifter Differential Input Circuit

SB="H"

SB="L"

Level Shifter Differential Input Circuit

Differential Input Circuit

DISPLAY DEVICE HAVING LOW VOLTAGE DIFFERENTIAL SIGNAL LINES OVERLAPPING DRIVE CIRCUITS

The present application claims priority from Japanese application JP2002-120891 filed on Apr. 25, 2003, the content of which is hereby incorporated by reference into this application.

BACKGROUND OF THE INVENTION

The present invention relates to a display device, and, more particularly, the invention relates to a display device in which noises and power consumption are reduced by optimizing a method for supplying display data to driver ICs mounted on the display device and by adopting a novel signal transmission circuit.

A liquid crystal display device operating on the basis a STN (Super Twisted Nematic) method or a TFT (Thin Film Transistor) method has been popularly used as a display device in a personal computer or the like. The liquid crystal display device includes a liquid crystal display panel and drive circuits which drive the liquid crystal display panel.

With respect to such a liquid crystal display device, there in a technique in which the drive circuit is formed as an integrated circuit on a silicon chip separately from the liquid crystal display panel, and the silicon chip in which the semiconductor circuit is formed is mounted on the liquid crystal display panel. As a method for mounting the silicon chip, there is a method in which a TCP (Tape Carrier Package) is used or a method in which a silicon chip is mounted on a transparent insulation substrate which forms a liquid crystal display panel, such as the so-called flip-chip method (FCA: Flip Chip Attachment) or COG (Chip On Glass) method.

In the typical liquid crystal display device, a signal is supplied through wiring formed in the printed wiring board. Further, the flip-chip method uses a so-called data sequential transmission method. In the data sequential transmission method, a signal is transmitted through wiring formed on the transparent insulation substrate, and signals are transmitted from one preceding silicon chip to a succeeding silicon chip.

Connection terminals (bumps) are formed on a silicon chip. In the flip-chip method, the connection terminals are electrically connected with electrodes on the transparent insulation substrate.

To drive circuits which are formed on the silicon chip, display data, control signals, power source voltages and the like are inputted from the outside through the connection terminals. The drive circuit outputs a drive signal, which is used to drive the liquid crystal display panel. In the data sequential transmission method, the drive circuit also outputs display data, control signals, power source voltages and the like for the next drive circuit through the wiring on the transparent insulated substrate.

For example, as a drive circuit which drives a TFT liquid crystal panel mounted on a notebook type computer or a liquid crystal display monitor, there is a drive circuit which rapidly inputs 6 bits for each of three dots of the three colors, consisting of red, blue and green (R, G, B), of one pixel, that is, 18 bits in total, and generates output voltages of 64 gray scale levels based on this digital data. In a data transmission method for an interface which uses CMOS circuits, an extremely rapid transmission and reception of signals is performed using 18 data lines and a drive frequency of 81 MHz.

Recently, in a liquid crystal display device, low voltage differential signals (LVDS) have been used as the signals which are inputted from an external device to realize an interface which transmits and receives digital data at a high speed. With the use of such low voltage differential signals, compared to the transmission method which uses CMOS circuits, it is expected that a reduction of the power consumption and an attenuation of the electromagnetic interference (EMI) by the input signals and the output signals can be achieved. Accordingly, in consideration of the current expectation that a liquid crystal panel for the next generation will demand higher definition and a larger screen, and that eventually the number of signal lines will be increased and the length of lines also will be increased, to solve drawbacks, such as an increase in the cost and a lowering of signal peak values, the use of low voltage differential signals has been proposed as a method for transmitting signals to the drive circuit and for receiving signals from the drive circuit in a liquid crystal display device.

Japanese Patent Laid-Open Publication No. H11(1999)-242463 discloses a technique for the use of low voltage differential signals for rapid signal transmission and reception. However, Japanese Patent Laid-Open Publication No. H11 (1999)-242463 fails to definitely disclose a proper layout of signal wiring and a proper mounting of drive circuits when low voltage differential signals are used in a method for transmitting signals to the drive circuit and for receiving signals from the drive circuit in the liquid crystal display device. Further, Japanese Patent Laid-Open Publication No. H11(1999)-242463 does not give consideration to practical problems which arise when the low voltage differential signals are used and means for overcoming such problems.

SUMMARY OF THE INVENTION

A brief summary of representative aspects of the invention disclosed in this specification is as follows.

According to the present invention, a liquid crystal display device includes a liquid crystal display panel and a plurality of drive circuits which drive the liquid crystal display panel, along with lines which supply signals to the drive circuits, wherein the drive circuit includes an input circuit which is connected with the lines and which inputs display data using low voltage differential signals, and an output circuit which outputs gray scale voltages in accordance with the display data, the low voltage differential signals inputted to the input circuit having a fixed level. The display lines are formed so as to overlap the drive circuits, and a level shift circuit is provided to the input circuit for changing the voltage level of the input signals.

Due to the above-mentioned constitution, it is possible to realize a liquid crystal display device which can realize rapid data transmission and low power consumption, and which includes an input circuit which is not readily influenced by fluctuation of the input signals.

DETAILED DESCRIPTION OF THE PREFERRED EMBODIMENTS

Hereinafter, embodiments of the present invention will be explained in detail in conjunction with the drawings. In all of the drawings, the same symbols identify parts having identical functions, and repeated explanations of these parts will be omitted.

Figure 1:
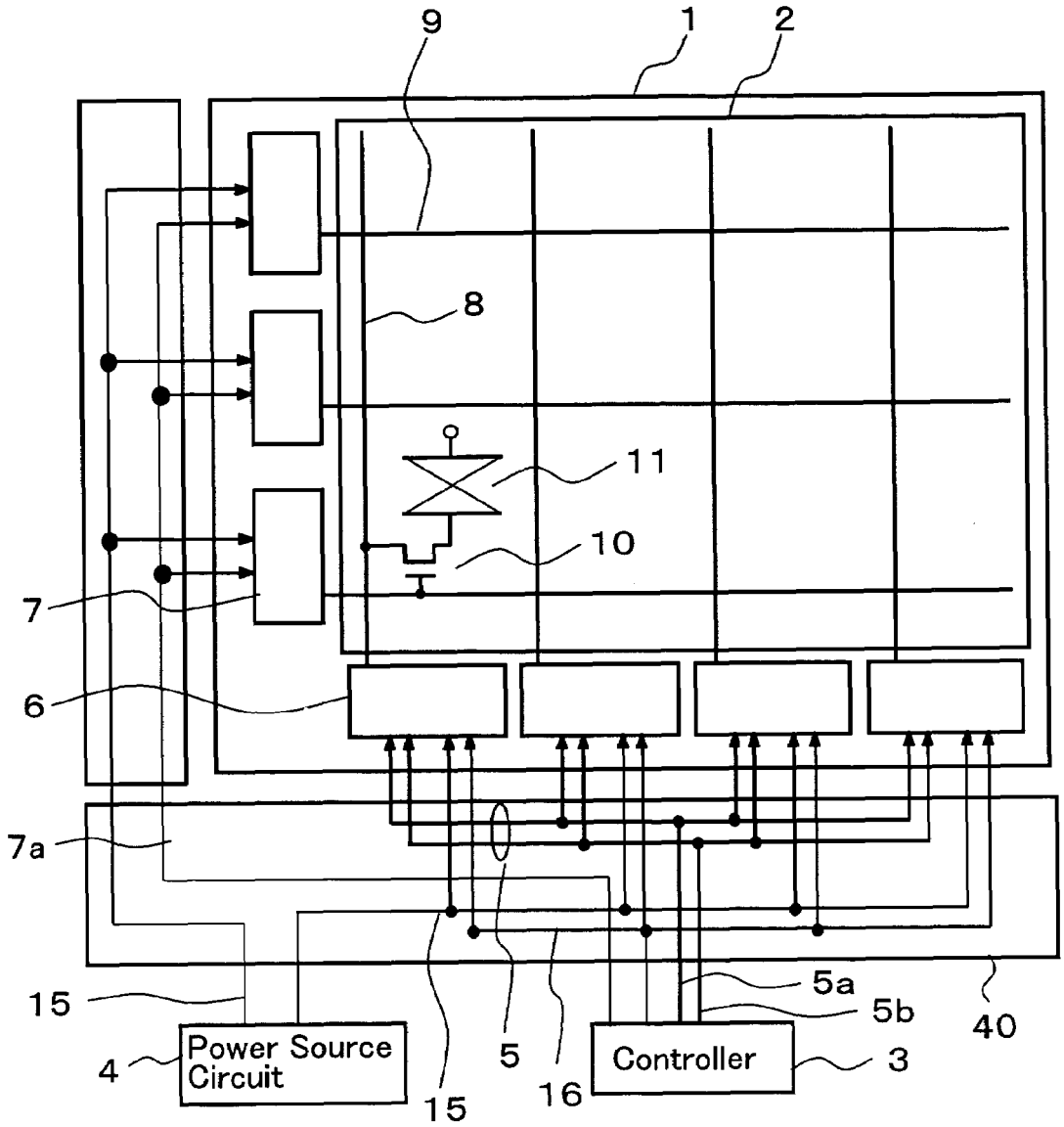
FIG. 1 is a block diagram showing the constitution of a liquid crystal display device according to an embodiment of the present invention.

FIG. 1 is a block diagram showing the constitution of a liquid crystal display device according to an embodiment of the present invention. In FIG. 1, the reference numeral 1 denotes a liquid crystal display panel and reference numeral 2 denotes a display section thereof. An image is displayed on the display section 2 in accordance with the applied display data.

The reference numeral 3 denotes a controller. Display data and control signals are inputted to the controller 3 from an outside device (a computer or the like). The controller 3 receives the display data, the control signals or the like, and then outputs display data, various kinds of clock signals, various kinds of control signals or the like. The controller 3 outputs those signals at a timing and in accordance with a sequence which conform to a display to be produced by the liquid crystal display panel 1. Reference numeral 4 denotes a power source circuit. The power source circuit 4 generates various kinds of driving voltages for driving the liquid crystal display panel 1.

A low voltage differential signal line 5 is connected to the controller 3. The low voltage differential signal line 5 is mounted on a printed wiring board 40. The controller 3 outputs low voltage differential signals to the low voltage differential signal line 5. Further, the low voltage differential signal line 5 is constituted of a data bus line 5*a* and a control signal line 5*b*, and the controller 3 outputs display data, using low voltage differential signals, to the data bus line 5*a*, and control signals, using low voltage differential signals, to the control signal line 5*b*.

Here, among the control signals, there is a signal which does not use a low voltage differential signal method. The signal which is not transmitted as a low voltage differential signal is outputted to a control signal line 16 from the controller 3.

As the control signals which the controller 3 outputs, there are clock signals which allow drain drivers 6 to receive the display data, clock signals for changing over the output from the drain drivers 6 to the liquid crystal display panel 1, timing signals 7*a*, such as a frame start indicating signal, which drives a gate driver 7, and gate clock signals for sequentially outputting scanning signals or the like.

Further, the power source circuit 4 generates positive gray scale voltages, negative gray scale voltages, counter electrode voltages, scanning signal voltages or the like, and it outputs these voltages to a power source line 15. Here, although power source lines which supply necessary power source voltages to the respective circuits are omitted from the drawing for simplifying the drawing, it is assumed that necessary power source voltages are supplied to the respective circuits.

The display data which is outputted from the controller 3 is transmitted to and is received by the drain driver 6 via the data bus line 5*a*. To cope with noises which are generated from the liquid crystal display device, and in view of the recognition that conventional signals can no longer ensure stable transmission of the signals, according to this embodiment, the display data is transmitted using low voltage differential signals from the controller 3 to the drain drivers 6.

The drain drivers 6 (the drive circuits) are arranged in the lateral direction (the x direction as seen in the drawing) along the periphery of the display section 2. Output terminals of the drain drivers 6 are connected to video signal lines 8 of the liquid crystal display panel 1. A plurality of video signal lines 8 extend in the y direction as seen in the drawing and are arranged in parallel in the x direction. Further, the respective video signal lines 8 are connected to drain electrodes of a plurality of thin film transistors (TFT) 10 which are formed on the display section 2. The drain drivers 6 receive the display data from the data bus line 5*a* and output gray scale voltages to the video signal line 8 in response to the display data. Voltages(gray scale voltage) for driving the liquid crystal are supplied to the thin film transistor 10 through the video signal lines 8.

Here, although the function of source and drain may be reversed in view of the bias relationship, in this embodiment, the electrode which is connected to the video signal line 8 is called the drain.

Gate drivers (scanning circuits) 7 are arranged along the periphery of the display part 2 in the vertical direction. Output terminals of the gate drivers 7 are connected to the scanning signal lines 9 of the liquid crystal display panel 1. The scanning signal lines 9 extend in the x direction as seen in the drawing and are connected to gate electrodes of the thin film transistors 10. Further, a plurality of scanning signal lines 9 are arranged in parallel in the y direction as seen in the drawing. In response to frame start indicating signals and shift clocks which are supplied to the gate drivers 7 from the controller 3, the gate drivers 7 supply a high level scanning voltage to the scanning signal lines 9 sequentially for every one horizontal scanning period. An ON-OFF control of the thin film transistors 10 is performed in response to the scanning voltages applied to the gate electrodes.

The display section 2 of the liquid crystal display panel 1 includes pixel portions 11, which are arranged in a matrix array. In this embodiment, however, for simplifying the drawing, only one pixel portion 11 is shown in FIG. 1. Each pixel portion 11 includes a thin film transistor 10 and a pixel electrode. Each pixel portion 11 is arranged in a region founded by two neighboring video signal lines 8 and two neighboring scanning signal lines 9 (a region surrounded by four signal lines).

As explained above, the scanning signal is outputted to the scanning signal lines 9 from the gate drivers 7. In response to the scanning signal, the thin film transistors 10 are turned on or off. The gray scale voltage is supplied to the video signal lines 8; and, when the thin film transistors 10 are turned on, the gray scale voltage is supplied to the pixel electrodes from the video signal lines 8. A counter electrode (common electrode) is arranged in such a manner that the counter electrode faces the pixel electrodes. A liquid crystal layer (not shown in the drawing) is inserted between the pixel electrodes and the counter electrode. In the circuit diagram shown in FIG. 1, a liquid crystal capacitance is connected equivalently between the pixel electrode and the counter electrode.

The orientation of the liquid crystal layer is changed by applying a voltage between the pixel electrode and the counter electrode. In the liquid crystal display panel, a display is produced using a phenomenon by which the optical transmissivity is changed in response to a change of orientation of the liquid crystal layer. An image which is displayed by the liquid crystal display panel 1 is constituted of pixels which are arranged in a matrix array. Gray scales of the respective pixels constituting the image are determined based on the voltages applied to the pixel electrodes. The drain drivers 6 receive the gray scales to be displayed using display data and output the corresponding gray scale voltages. Therefore, in response to an increase in the number of gray scales which are displayed by the liquid crystal display panel 1, the data quantity of the display data or the number of data bus lines 5*a* must be increased, and the transmission rate or speed of the display data is accelerated.

It is known that the liquid crystal is deteriorated when a DC voltage is applied to the liquid crystal for a long time. For preventing such deterioration of the liquid crystal, AC driving is employed, in which the polarity of voltage applied to the liquid crystal layer is reversed periodically. In such AC driving, positive and negative signal voltages with respect to the counter electrode are applied to the pixel electrodes. Accordingly, the power source circuit 4 includes a positive gray scale voltage generation circuit and a negative gray scale voltage generation circuit. The drain drivers 6 select positive/negative gray scale voltages in response to the AC signals even when the same display data is supplied to the drain drivers 6.

Figure 2:
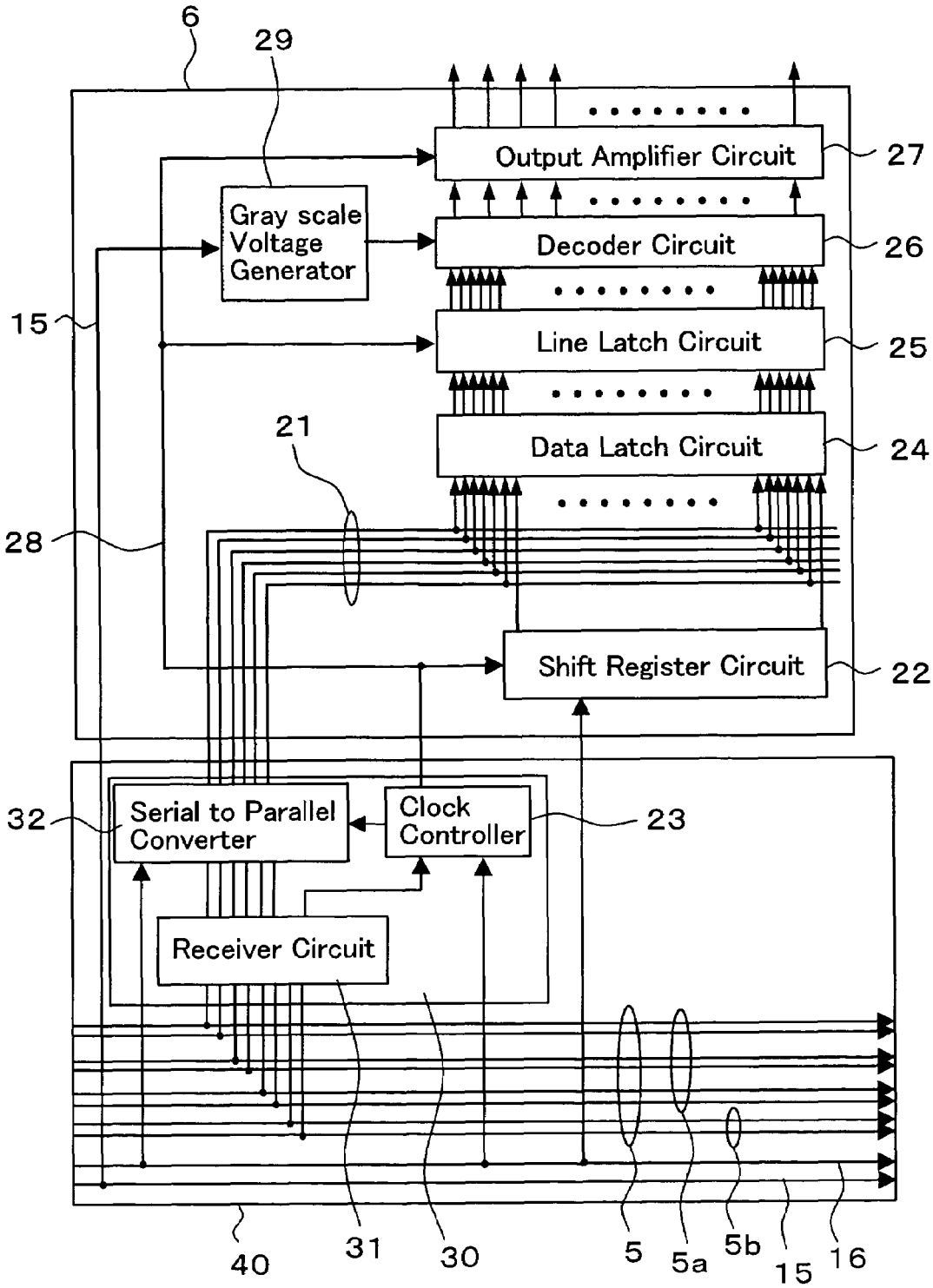
FIG. 2 is a schematic block diagram of a drain driver of the liquid crystal display device according to the embodiment of the present invention.

FIG. 2 shows a schematic block diagram of the inside of the drain driver 6 and a low voltage differential signal circuit 30. The display data using a low voltage differential signal, which is outputted from the controller 3, is inputted to a receiver circuit 31 via the data bus line 5*a*, which is mounted on the printed wiring board 40. The receiver circuit 31 is mounted on the printed wiring board 40 for each drain driver 6. The receiver circuit 31 converts (calculates) the low voltage differential signal into a signal of a signal waveform having a high level voltage and a signal of a low level voltage, which can be used in a circuit within the drain driver 6. Here, the receiver circuit 31 will be explained in detail later.

Although the data bus lines 5*a* are indicated as being six lines in FIG. 2 for simplifying the drawing, the display data is transmitted using low voltage differential signals, and the number of the data bus lines 5*a* is determined based on the quantity of data to be transmitted. Using two (one pair) low voltage differential signals, one signal is transmitted. Further, the display data is transmitted in series using a pair of signal lines. Here, although the data bus lines 5*a* are indicated as being six lines in FIG. 2, the number of pairs of the data bus lines 5*a* can be set to any arbitrary number. Numeral 5*b* indicates clock signal lines which transmit the clock signals using low voltage differential signals, and these lines are used for transmission of the clock signal which indicates the timing for fetching the low voltage differential signals or the like.

The clock signal which is inputted to the receiver circuit 31 is transmitted to a clock controller 23. and the clock controller 23 outputs an internal clock which is used in the inside of the drain driver 6.

A serial/parallel conversion circuit 32 converts the low voltage differential signals supplied to the serial/parallel conversion circuit 32 as serial signals into parallel signals. Accordingly, when the gray scales are expressed in six bits in the inside of the drain driver 6, internal data bus lines 21 which transmit the display data converted into parallel data become six lines. Here, when respective colors of R, G, B are transmitted as a set, the number of the internal data bus lines 21 used in the circuit becomes eighteen in total, since each color requires six internal data bus lines 21.

In the serial/parallel conversion circuit 32, the display data is synchronized with the inner clock signal which the clock controller 23 outputs and the synchronized display data is outputted to the internal data bus line 21. The internal clock signal is also inputted to the shift register circuit 22 from the clock controller 23, and the shift register circuit 22 sequentially outputs a timing signal in response to the internal clock signal.

When the timing signal is inputted to a data latch circuit 24, the data latch circuit 24 fetches the display data on the internal data bus line 21. In a state in which the display data is fetched into all data latch circuits 24, the display data of the data latch circuit 24 is fetched to a line latch circuit 25. The line latch circuit 25 outputs the display data to a decoder circuit 26. To the decoder circuit 26, respective gray scale voltages are inputted from a gray scale voltage generation circuit 29. In the decoder circuit 26, the gray scale voltages which conform to the display data are selected and the selected gray scale voltages are inputted to an output amplifier circuit 27. Further, the output amplifier circuit 27 performs a current amplification of the gray scale voltages and outputs the amplified gray scale voltages to the liquid crystal display panel 1 (not shown in the drawing). Numeral 15 indicates a voltage supply line which supplies a required voltage to the gray scale voltage generating circuit 29. Here, although lines for supplying the power source voltages to the respective circuits are omitted in FIG. 2, required voltages are supplied to the respective circuits. Further, numeral 16 indicates an auxiliary clock signal line which is provided for transmitting an arbitrary timing to the drain drivers 6 separately from the clock signal line 5*b* when necessary.

Figure 3:
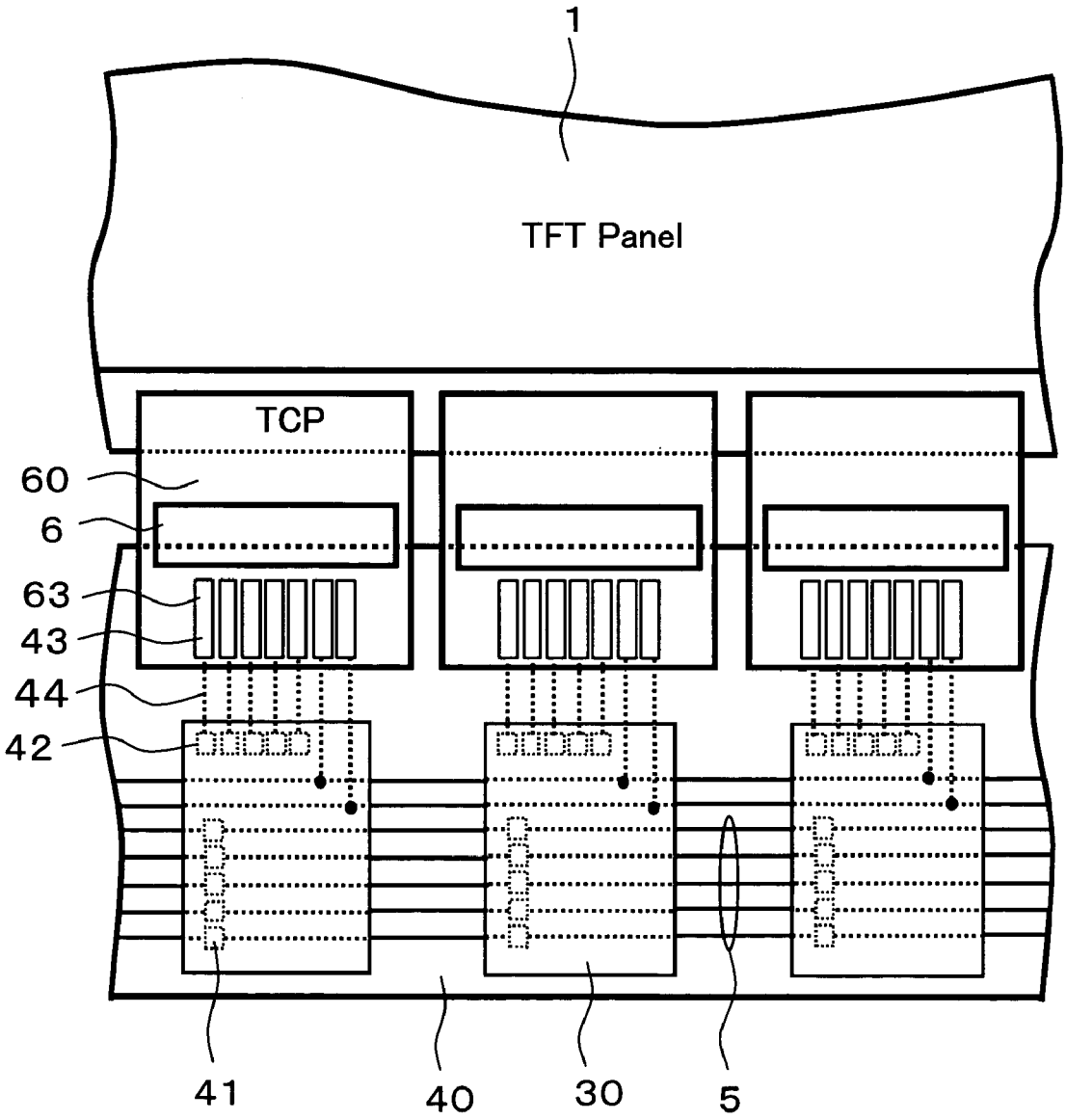
FIG. 3 is a block diagram showing the constitution of the liquid crystal display device according to the embodiment of the present invention.

FIG. 3 shows the constitution in which the low voltage differential signal circuits 30 are arranged on the printed wiring board 40. The low voltage differential signal lines 5, which are formed on the printed wiring board 40, and the connection terminals 41 are connected, and the low voltage differential signal is inputted to the low voltage differential signal circuits 30 through the connection terminals 41. The low voltage differential signal circuits 30 include a receiver circuit 31, the serial/parallel converting circuit 32 and the clock controller 23, wherein the low voltage differential signals are converted into signals available to the drain driver 6. Lines 44 are provided between the low voltage differential signal circuits 30 and the drain driver 6, and the signals which are outputted from output terminals 42 are transmitted to input terminals 63 via the lines 44. Here, below the input terminals 63, the connection terminals 43 are formed on the printed wiring board 40 such that the connection terminals 43 are overlapped to the input terminals 63.

The drain driver 6 is mounted on the flexible printed circuit board, and this constitutes a tape carrier package 60. The tape carrier package 60 includes the above-mentioned input terminals 63, and the signals are inputted to the drain driver 6 via the input terminals 63. Signals which drive the liquid crystal display panel 1 are outputted from the drain driver 6. The signals which are outputted from the drain driver 6 are transmitted to the liquid crystal display panel 1 using output terminals (not shown in the drawing) mounted on the tape carrier package 60.

In FIG. 3, the low voltage differential signal lines 5, which are mounted on the printed wiring board 40, connect linearly between the respective low voltage differential signal circuits 30, and respective signal lines which constitute the low voltage differential signal lines 5 have the same line length. With respect to the low voltage differential signals, it is necessary to transmit the respective signals under the same conditions, and, hence, it is required that the line lengths of the signal lines which transmit the signals are set as equal as possible. In FIG. 3, the low voltage differential signal circuits 30 are provided independently from the drain drivers 6, and, hence, there is no possibility that the input terminals of the low voltage differential signal circuits 30 are restricted due to the positions or the like of the drain drivers 6. Accordingly, it is possible to form the input terminals of the low voltage differential signal circuits 30 in conformity with the linear low voltage differential signal lines 5, and, hence, the low voltage differential signal lines 5 can be arranged linearly.

Figure 4:
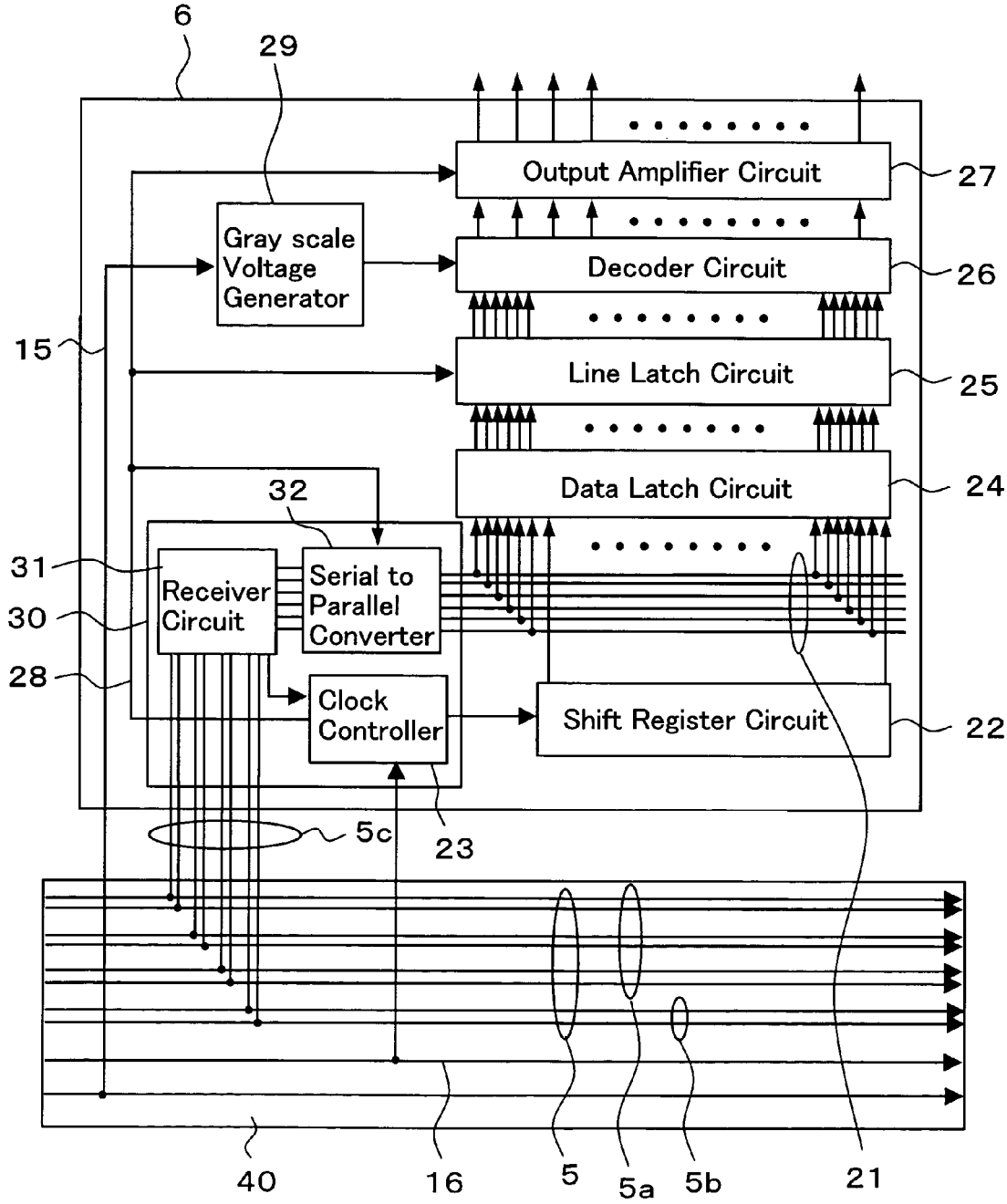
FIG. 4 is a schematic block diagram of a drain driver of the liquid crystal display device according to the embodiment of the present invention.

Next, an explanation will be given with respect to a case in which the low voltage differential signal circuits 30 are formed in the inside of the drain driver 6, in conjunction with FIG. 4. In FIG. 4, the receiver circuit 31, the serial/parallel conversion circuit 32 and the clock controller 23 are formed in the inside of the drain driver 6.

By integrally forming the low voltage differential signal circuits 30 in the inside of the drain driver 6, lines which connect between the low voltage differential signal circuits 30 and the drain driver 6 can be formed using lines inside the drain driver 6, and, hence, certain elements, such as connection terminals, can be eliminated. Further, it is also possible to obtain advantageous effects in that the number of parts can be reduced, the power consumption can be reduced, and the manufacturing cost can be reduced.

Lead lines 5*c* extend from the data bus lines 5*a* formed on the printed wiring board 40 to the receiver circuit 31. As described previously, with respect to the low voltage differential signals, it is desirable that the line lengths of the signal lines are equal for respective signals, and, hence, it is necessary to prevent the lengths of the respective lead lines 5*c* from becoming non-uniform depending on the signals. However, it is difficult to make the lead lines 5*c* have a uniform length. The reason for this will be explained in conjunction with FIG. 5A.

Figure 5A:
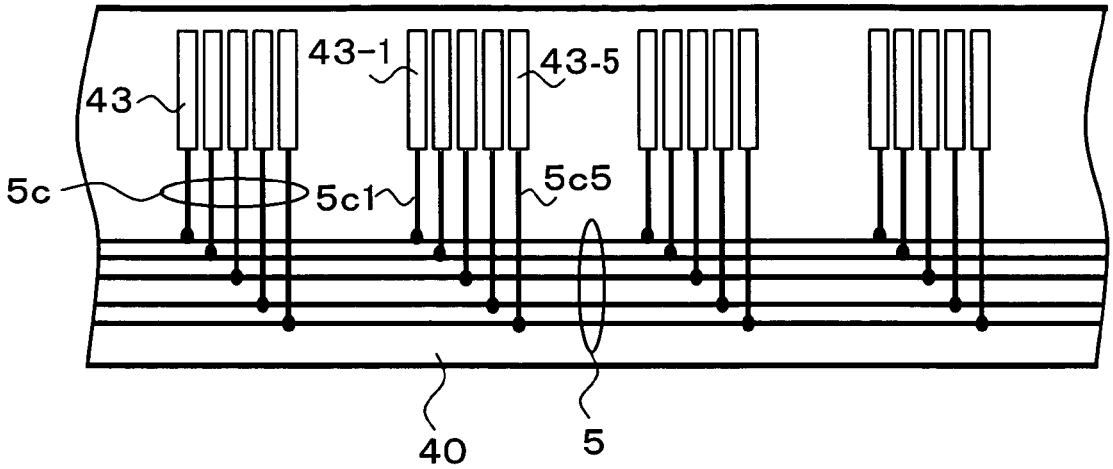
FIGS. 5A and 5B are diagrams of signal lines of the liquid crystal display device according to the embodiment of the present invention.

In FIG. 5A, while connection terminals 43, which are connected with the drain driver 6, are formed on the printed wiring board 40, lead lines 5*c* are formed on the printed wiring board 40 for connecting between the connection terminals 43 and the low voltage differential signal lines 5. Comparing the connection terminal 43-1 of the connection terminals 43 at the left end as seen in the drawing and the connection terminal 43-5 of the terminals 43 at the right end as seen in the drawing, to ensure a width for forming the low voltage differential signal lines 5, the lead line 5*c*5 is elongated compared to the lead line 5*c*1. Further, since the connection terminal 43-1 is arranged at the left side compared to the connection terminal 43-5 due to the width of the connection terminal 43, the connection terminal 43-5 is arranged at a position more remote from an arbitrary point at the left side. Accordingly, the line extending to the connection terminal 43-5 becomes longer than the line extending to the connection terminal 43-1.

Figure 5B:
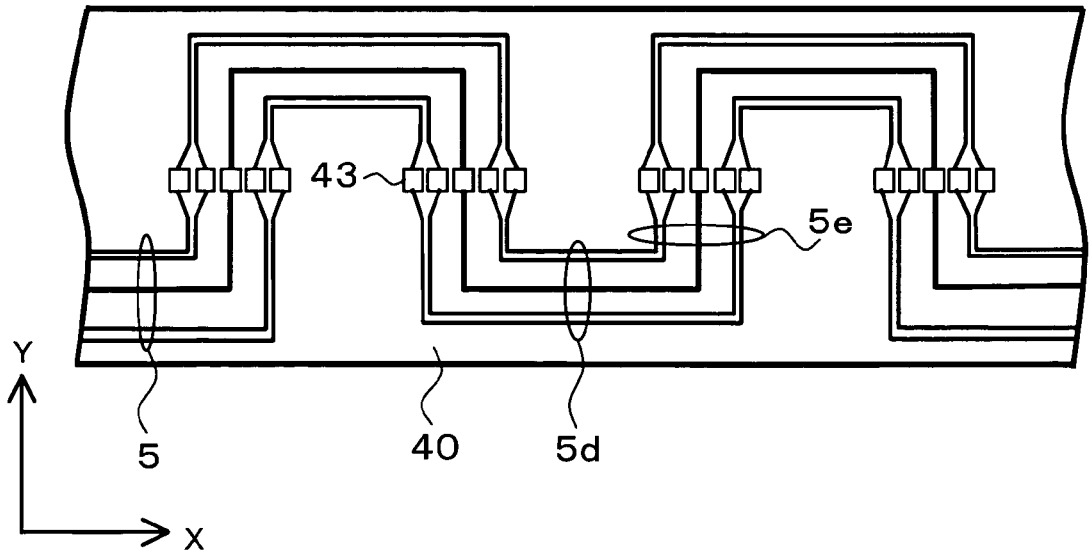

For this reason, when the low voltage differential signal circuit 30 is integrally formed in the inside of the drain driver 6, there arises a drawback in that the lengths of the lines become non-uniform or irregular. Accordingly, the wiring arrangement shown in FIG. 5B is adopted (since the wiring is a wiring which connects a starting point and a finishing point with one stroke, the wiring is also referred to as a one-stroke wiring). The low voltage differential signal lines 5 shown in FIG. 5B are constituted of line portions 5*d* which extend in the direction along the long side of the printed wiring board 40 (X direction as seen in the drawing) and line portions 5*e* which extend in the direction which intersects the long side (Y direction as seen in the drawing), and the line portions 5*e* are connected to the connection terminals 43 continuously extend in the Y direction. That is, the low voltage differential signal lines 5 extend along the long-side direction of the printed wiring board 40 and, at the same time, are zigzagged to be connected with the connection terminals 43.

The low voltage differential signal lines 5, as shown in FIG. 5B are not formed in a pattern in which the lines to be connected to the connection terminals 43 are branched, but they are formed in a zigzag pattern in which the low voltage differential signal lines 5 connect between the connection terminals 43 with a one stroke line. By forming the respective signal lines of the low voltage differential signal lines 5 in parallel and by making the respective lines have such a zigzag pattern, it is possible to make the conditions of these signal lines such that the line lengths thereof are substantially equal.

Here, although the low voltage differential signal lines 5 are constituted of five lines in FIG. 5B, it is possible to provide a desired number of low voltage differential signal lines 5 when necessary. Further, out of five signal lines, one signal line at the center constitutes a signal line of a fixed voltage and signal lines at both sides respectively constitute pairs each consisting of two signal lines. Further, the signal lines which constitutes pairs are formed such that the interval thereof is small compared to the connection terminals 43, which are provided at an equal distance. By forming the signal lines in this manner, the signal lines are hardly subjected to any influence by noise, and, at the same time, any influence of noise appears on the pair of signal lines in the same manner.

Figure 6:
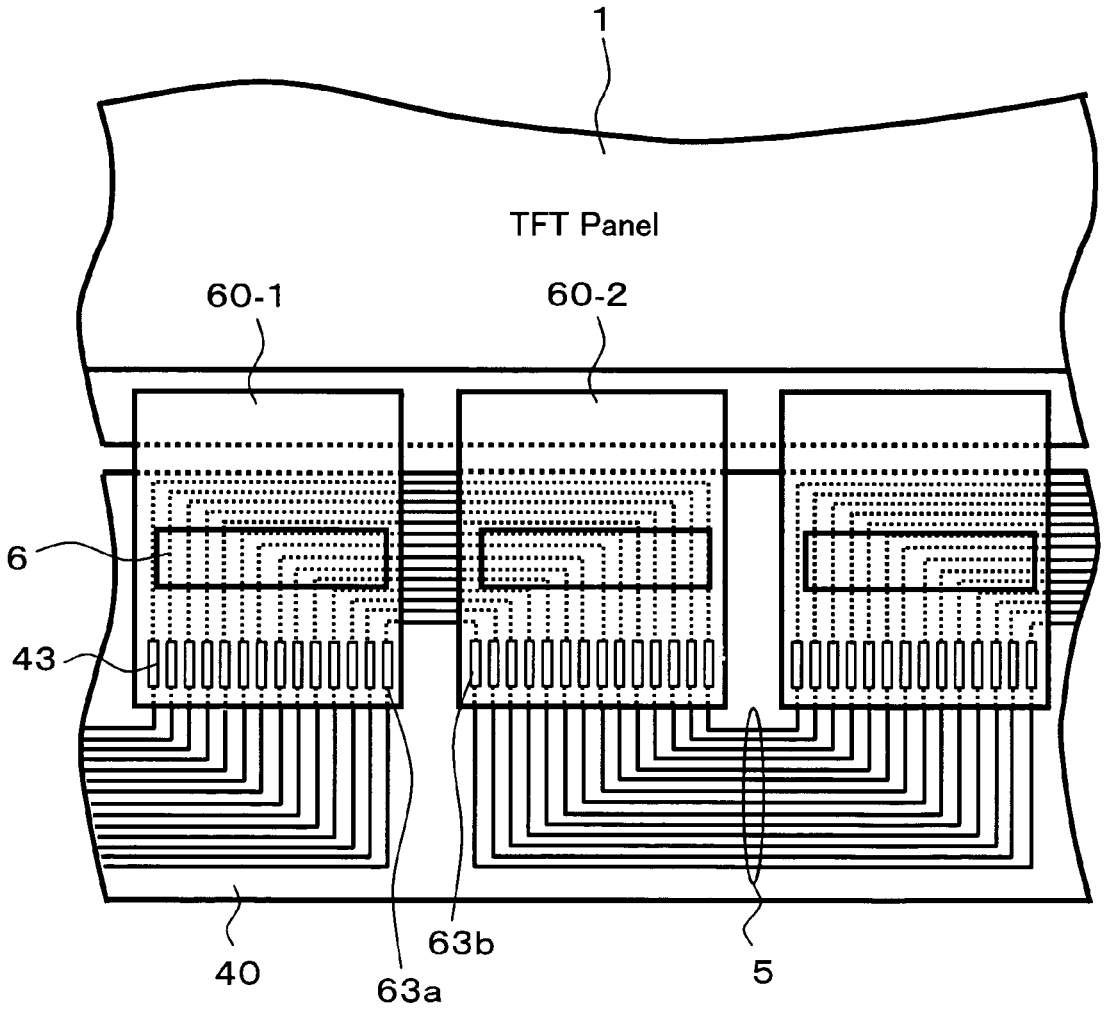
FIG. 6 is a diagram showing the constitution of the liquid crystal display device according to the embodiment of the present invention.

FIG. 6 shows a state in which the low voltage differential signal lines 5 are formed on the printed wiring board 40 by one-stroke wiring and the tape carrier packages 60 are mounted on the liquid crystal display panel 1 and the printed wiring board 40. The low voltage differential signal lines 5 extend continuously even after being connected with the connection terminals 43; and, hence, for example, in the tape carrier package 60-1, the low voltage differential signal lines are formed to be overlapped to the drain driver 6. Further, an input terminal 63-*a* at the right end of the tape carrier package 60-1 is connected with an input terminal 63-*b* at a left end of the tape carrier package 60-2 by the low voltage differential signal line 5.

When the low voltage differential signal line 5 is formed by the one stroke wiring method described above, it is necessary to provide two kinds of tape carrier packages which have the arrangements of the input terminals 63 thereof opposite from each other, and, hence, there arises a drawback in that the operability of assembling is deteriorated, including the necessity to confirm the kinds of tape carrier packages at the time of performing the assembling.

Figure 7A:
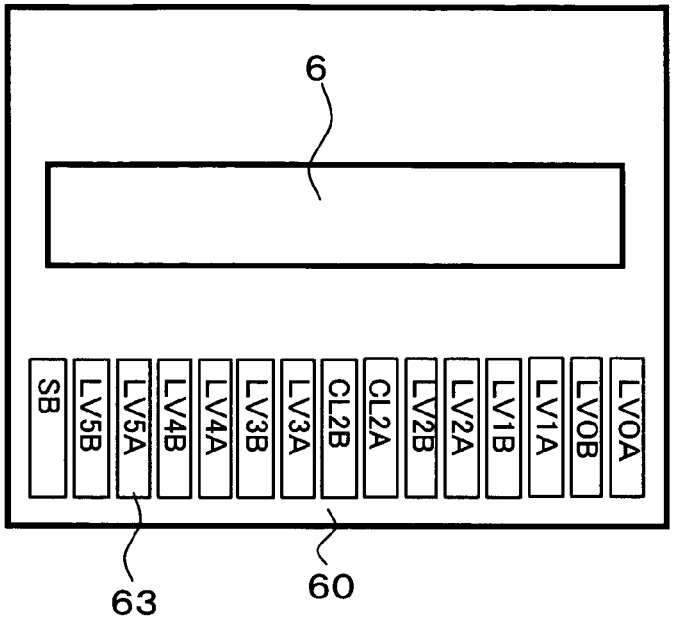
FIGS. 7A, 7B and 7C are diagrams showing input terminals of drive circuits of the liquid crystal display device according to the embodiment of the present invention.

Next, the input terminals 63 of the tape carrier package 60, which can overcome the above-mentioned drawbacks, will be explained in conjunction with FIGS. 7A to 7C. FIG. 7A shows one example of the input terminals 63 connected to the low voltage differential signal lines 5. However, a terminal SB at the left end as seen in the drawing is a control signal input terminal (a bus inversion terminal) to which a signal which controls the function of the terminals is inputted, and, hence, the low voltage differential signal is not inputted to the terminal SB.

On the tape carrier package 60 shown in FIG. 7A, fourteen input terminals, including input terminals ranging from LV0A, LV0B to LV5A, LV5B, and the clock signal input terminals CL2A, CL2B positioned at the center are formed. Respective input terminals constitute pairs, each consisting of A and B terminals, and, hence, seven pairs of input terminals are provided. The functions of the respective input terminals are not fixed, and the functions can be changed in response to the values of signals inputted to the control signal terminal SB.

Figure 7B:
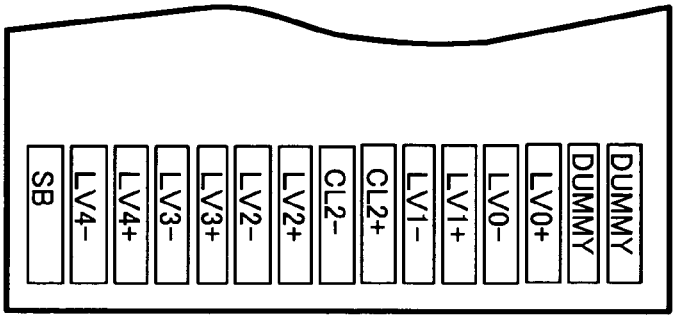
Figure 7C:
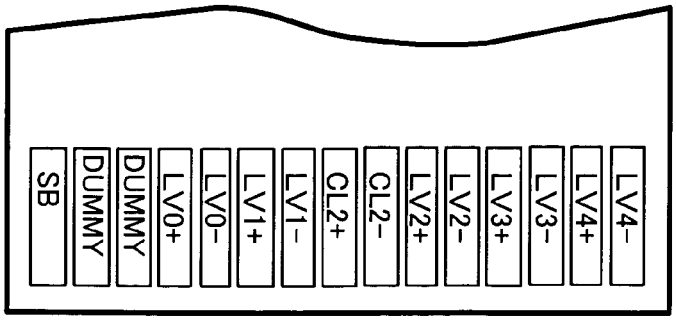

FIG. 7B shows a state in which the High level signal (SB="H") is inputted to the control signal terminal SB, wherein the input terminals LV0A, LV0B constitute dummy terminals (symbol: DUMMY), the input terminal LV5B constitutes a signal LV4−input terminal, and the input terminal LV5A constitutes a signal LV4+input terminal. Next, when the Low level signal (SB="L") is inputted to the control signal terminal SB as shown in FIG. 7C, the input terminal LV0A constitutes the signal LV4−input terminal, the input terminal LV0B constitutes the signal LV4+input terminal, and the input terminals LV5A, LV5B constitute the dummy terminals (DUMMY). Here, the clock signal input terminals CL2A, CL2B positioned at the center are held as the clock signal input terminals. The dummy terminals (DUMMY) imply terminals to which the signals which are treated as low voltage differential signals are not inputted. The dummy terminals may be configured to be changed over in function as the low voltage differential signal input terminals in response to the control signals or the like when the number of gray scales or the number of pixels is increased.

In this manner, by inverting the functions of the input terminals through provision of the control signal terminal SB, even when the low voltage differential signal lines 5 are formed by one stroke wiring, it is possible to perform the assembling operation using one kind of tape carrier package 60 and to realize a tape carrier package 60 that has two kinds of terminal functions in response to signals after completion of the liquid crystal display device.

Figure 8:
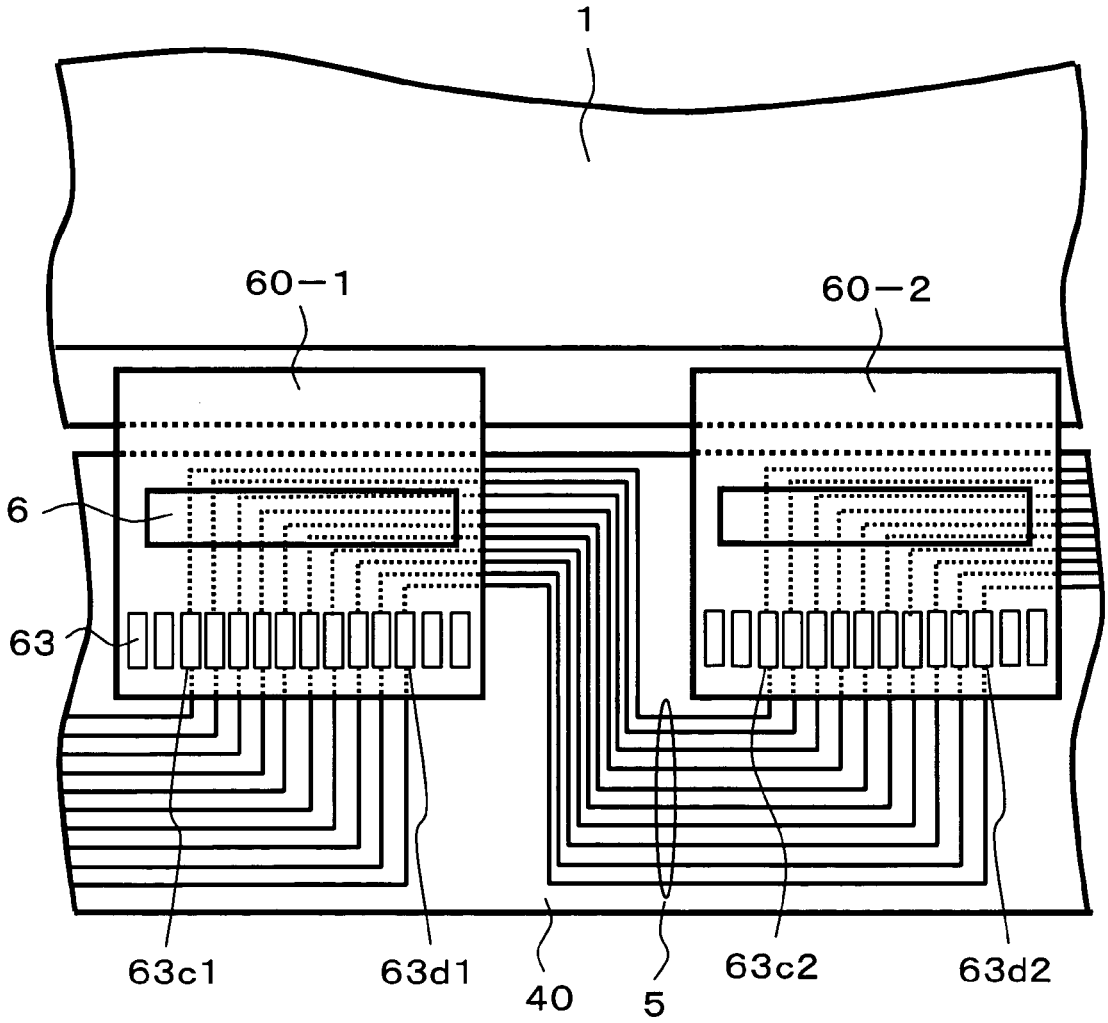
FIG. 8 is a diagram showing the constitution of the liquid crystal display device according to the embodiment of the present invention.

Next, an explanation will be made with respect to the low voltage differential signal lines 5 which make the connection terminals 63 of two tape carrier packages 60-1 and 60-2 have an S-shape zigzag pattern. In the low voltage differential signal lines 5 shown in FIG. 8, input terminals 63*c*-1 at the left end of the tape carrier package 60-1 and input terminals 63*c*-2 at the left end of the tape carrier package 60-2 are connected to each other, and, hence, it is not necessary to invert the functions of the input terminals between the tape carrier packages 60-1 and 60-2. However, since a large number of low voltage differential signal lines 5 are formed in the longitudinal direction (Y direction) as seen in the drawing between the tape carrier packages 60-1 and 60-2, there arises a drawback in that the wiring region is widened.

Figure 9:
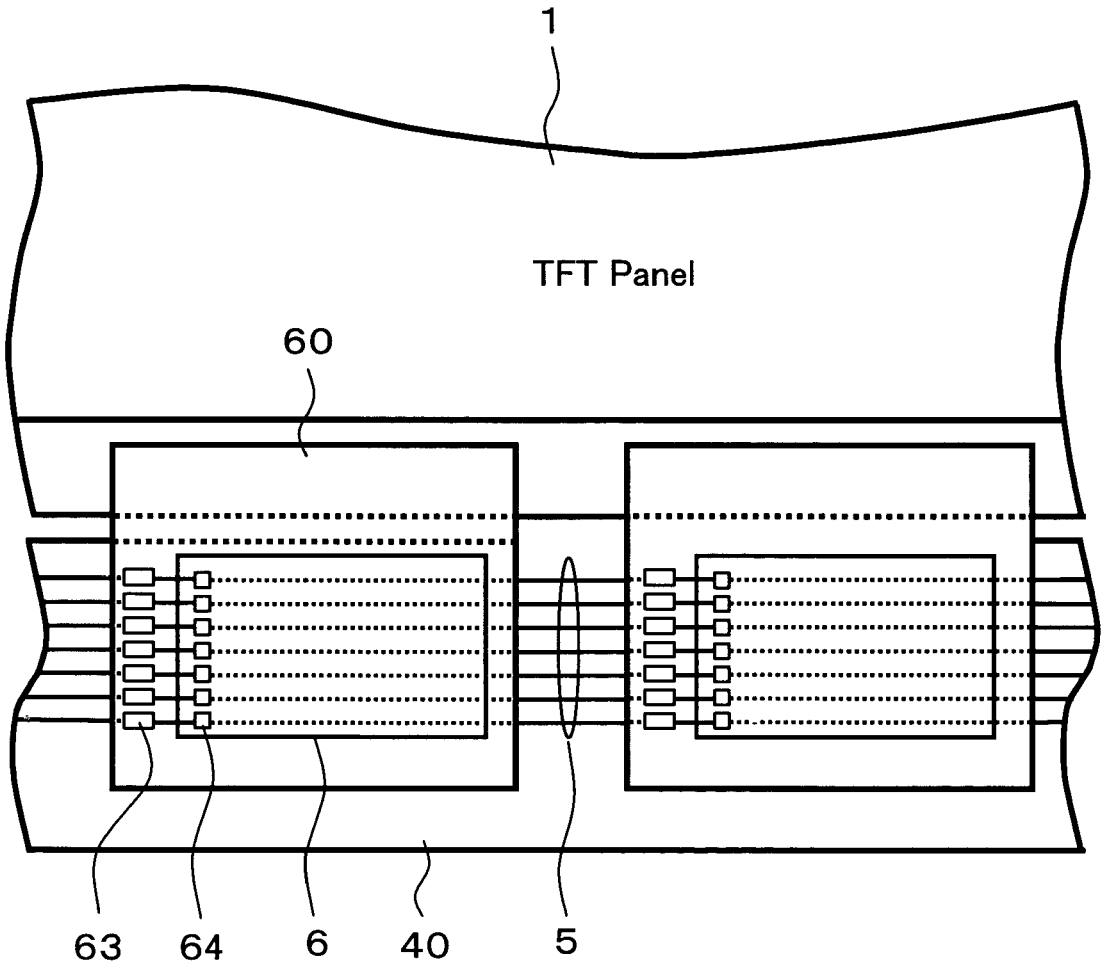
FIG. 9 is a diagram showing the constitution of the liquid crystal display device according to the embodiment of the present invention.

Next, FIG. 9 shows a constitution in which the low voltage differential signal lines 5 are disposed linearly by forming the input terminals 63 in parallel in the same direction as the direction (Y direction) along which the low voltage differential signal lines 5 are arranged. The low voltage differential signal lines 5 are connected with input terminals 63 which are provided at the left or right end portion (the left end in the drawing) of the tape carrier package 60. The input terminals 63 and input pads 64 of the drain driver 6 are connected by lines formed in the tape carrier package 60, and, hence, the signals are transmitted to the drain drivers 6. Here, the low voltage differential signal lines 5 are provided below the drain driver 6 in an overlapped manner.

Figure 10:
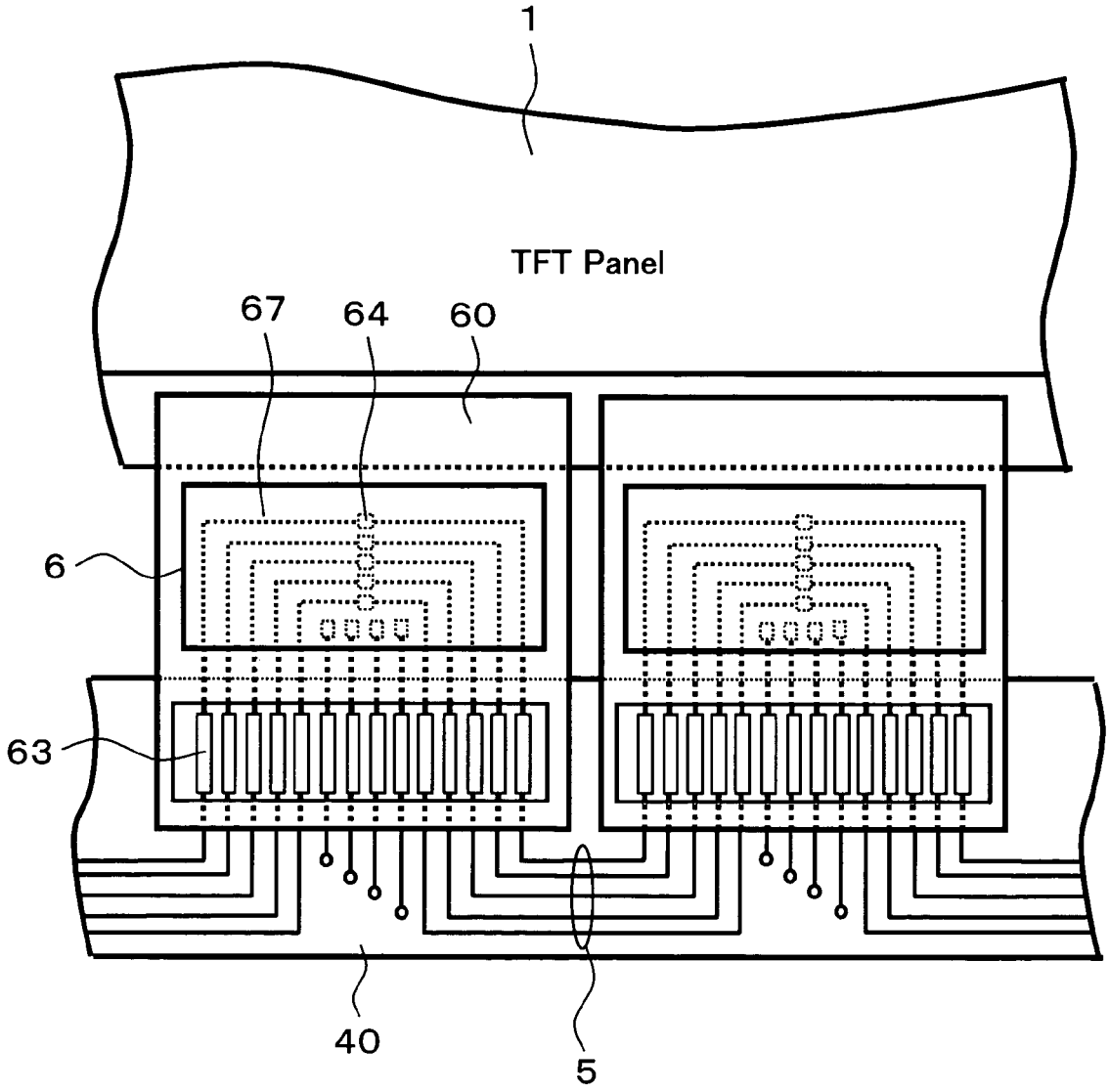
FIG. 10 is a diagram showing the constitution of the liquid crystal display device according to the embodiment of the present invention.

FIG. 10 shows a constitution in which the zigzag low voltage differential signal lines 5 have the lines thereof at the liquid crystal display panel 1 side formed on the tape carrier package 60. The low voltage differential signal lines 5, which are formed on the printed wiring board 40, are connected with lines 67 formed on the tape carrier package 60 at the input terminals 63. The lines 67 are connected with the drain driver 6 at input pads 64 and, thereafter, are pulled out to the printed wiring board 40 side and, thereafter, are connected with the printed-wiring-board-40-side low voltage differential signal lines 5 again at the input terminals 63.

Figure 11:
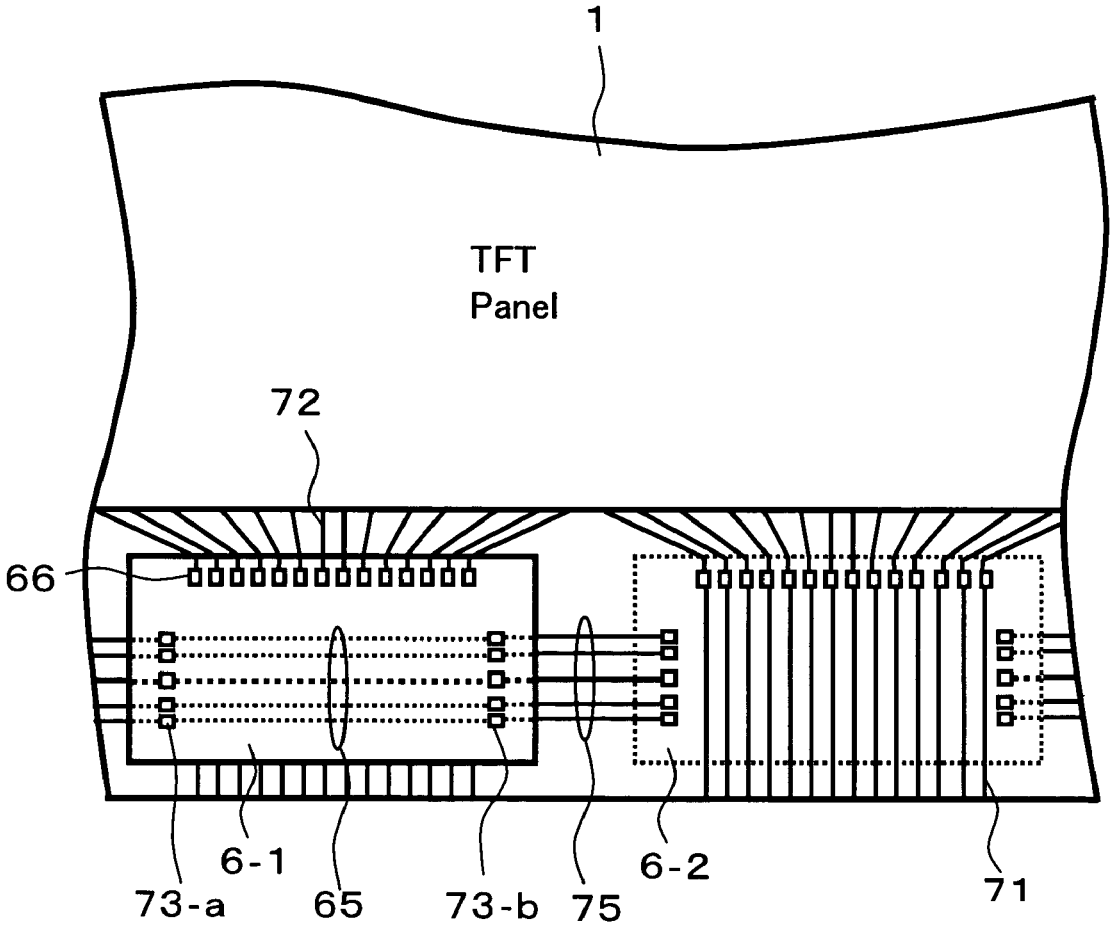
FIG. 11 is a diagram showing the schematic constitution of the liquid crystal display device according to the embodiment of the present invention.

Next, in conjunction with FIG. 11, an explanation will be made with respect to an example of the data sequential transmission method. In the data sequential transmission method, low voltage differential signal lines are formed on the liquid crystal display panel 1, and the drain driver 6 is directly mounted on the liquid crystal display panel 1. The low voltage differential signal lines 75 extend along the lateral direction (X direction) as seen in the drawing and are connected between connection terminals 73 formed on the liquid crystal display panel. Further, low voltage differential signal lines 65 are also formed on the drain driver 6. Signals which are inputted to the drain driver 6 through connection terminals 73-*a* at the left side as seen in the drawing are transmitted to the low voltage differential signal lines 65 formed on the drain driver 6 and, thereafter, are transmitted to the low voltage differential signal lines 75 from connection terminals 73-*b* at the right side.

To illustrate the static-electricity countermeasure lines 71, the profile of a position where the right-side drain driver 6-2 is mounted is indicated by a dotted line. The static-electricity countermeasure lines 71 are connected to output pads 66 of the drain driver 6 and are pulled out to an end portion of the liquid crystal display panel 1. On the other hand, while the lead lines 72 are connected to the output pads 66, extensions of the lead lines 72 are connected to video signal lines and thin film transistors of pixel portions (not shown in the drawing). Accordingly, to protect the thin film transistors from electrostatic breakdown, in the course of the manufacturing steps, the static-electricity countermeasure lines 71 are connected in common at the outside of an end portion of the liquid crystal display panel 1. Since the low voltage differential signal lines 75 are arranged to cross the static-electricity countermeasure lines 71, as seen in FIG. 11, the crossing portions are formed at the drain driver 6 side and constitute the low voltage differential signal lines 65.

Figure 12:
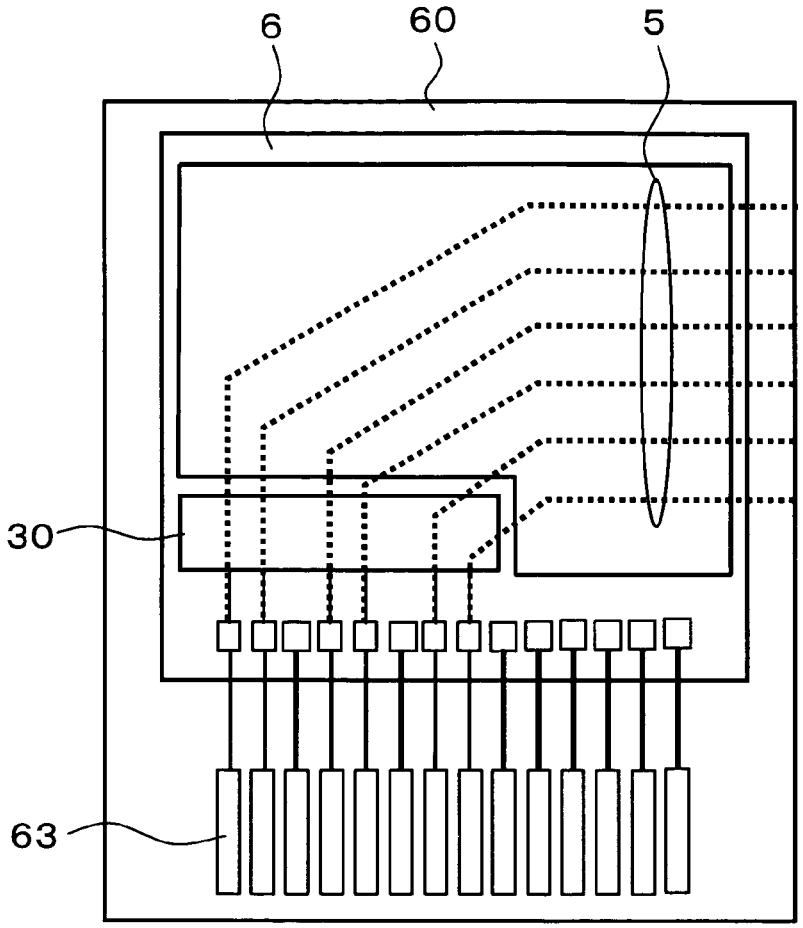
FIG. 12 is a diagram showing a drive circuit and input terminals of the liquid crystal display device according to the embodiment of the present invention.

As explained previously, with respect to the low voltage differential signals, it is necessary to transmit the respective signals under the same conditions, and, hence, respective signal lines which constitute the low voltage differential signal lines 5 are configured to have substantially the same line length. Accordingly, the low voltage differential signal lines 5 are formed in a zigzag pattern so as to be connected with the connection terminals 43 without being branched. By forming the low voltage differential signal lines 5 in a zigzag pattern, the low voltage differential signal lines 5 are arranged to be overlapped relative to the drain driver 6, as shown in FIG. 12. Further, the low voltage differential signal lines 5 are also overlapped relative to the low voltage differential signal circuit 30.

Next, an explanation will be made with respect to a problem which arises due to the constitution in which the low voltage differential signal lines 5 and the low voltage differential signal circuit 30 are overlapped relative to each other.

The low voltage differential signals have a small amplitude and exhibit weak resistance against noises, and, hence, the signals are set in a differential form. Further, when the frequency of the low voltage differential signals is high, it is necessary to make the lengths of the wiring paths uniform. Accordingly, as described previously, the low voltage differential signals lines are formed as zigzagged lines. Due to such a constitution, the non-uniformity of the length is eliminated and skews in wiring can be reduced. However, in the low voltage differential signal lines 5 having such a zigzag pattern, although the problem on skews can be overcome, an interference between the circuit inside the chip and the wiring occurs. Where both chips which generate the interference and chips which do not generate the interference are present, this brings about a situation in which only a portion of the differential signals carries the coupling noises. Although it is a requisite for a circuit to ensure a stable operation of the circuit in which the range of an input differential part is fixed, when only a portion of the differential signals carries the coupling noises, although the phases of the respective signals match each other, the levels become different from each other. Although a differential input part can obtain a stable operation provided that the signals are always inputted at a fixed level, there arises a drawback in that the zigzagged low voltage differential signal lines 5 cannot obtain a stable operation of the differential input part.

Figure 13:
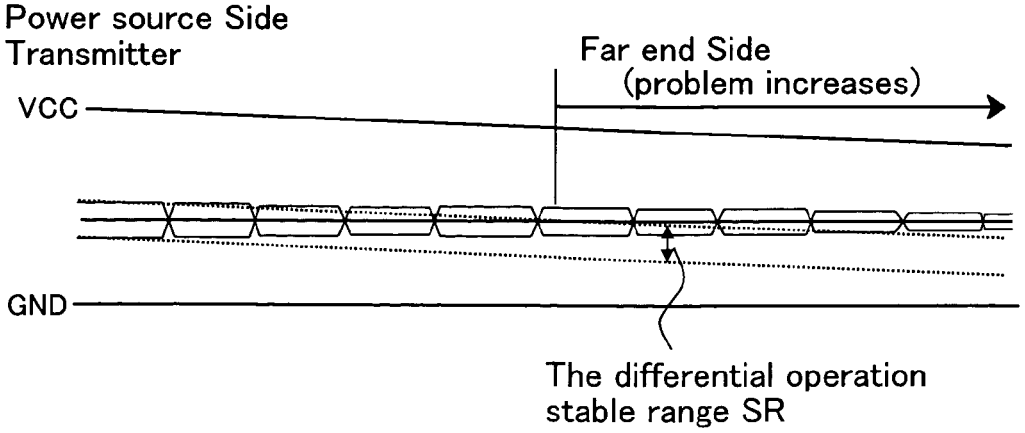
FIG. 13 is a signal diagram showing a signal waveform of the liquid crystal display device according to the embodiment of the present invention.

Further, since the low voltage differential signals have a small amplitude, the charging/discharging time can be shortened with respect to the wiring capacity and the input capacity of the driver, whereby the low voltage differential signals are suitable for rapid data signal processing. Also, from this viewpoint, the low voltage differential signals are suitable for wiring of a large-sized panel. Further, the charging/discharging current of the transmission path is reduced, and the current path starts from a transmitter and returns to the transmitter; and, hence, there is no mismatching of current paths, whereby the low voltage differential signals exhibit a strong resistance against electromagnetic interference (EMI). Further, when the liquid crystal display panel becomes large-sized, the substrate becomes large-sized, and, hence, there arises a lowering of the power source voltage or a lowering of the differential amplitude in the wiring. FIG. 13 shows the influence of these phenomena. The more remote the wiring is from a power source, the more the power source voltage is lowered due to the consumption of current by the driver per se; and, further, the differential amplitude is also made small due to the wiring resistance of the substrate. When the differential signal exceeds a stable input range, the waveform of the differential output is changed, and, hence, the operation point of an inverter of a succeeding stage is displaced, thus inducing the displacement of the phase of the output of a receiver. Further, when the displacement of the input range is large, the liquid crystal display panel becomes inoperable.

Figure 14:
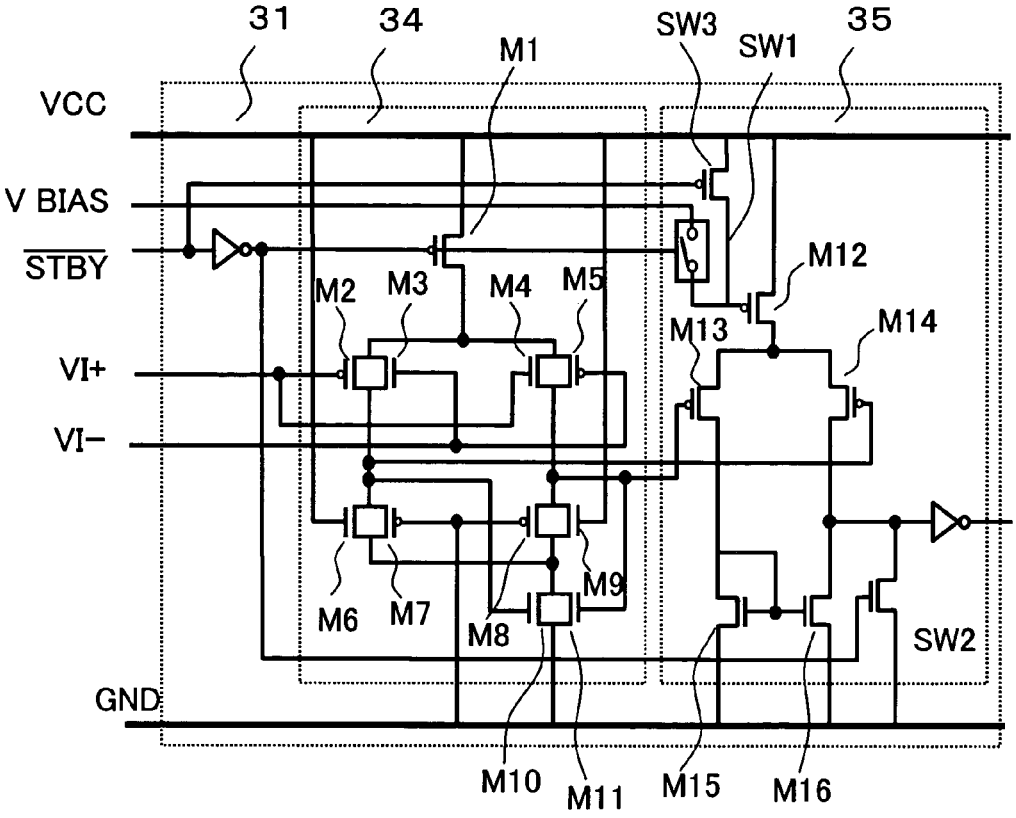
FIG. 14 is a schematic diagram showing an input circuit of the liquid crystal display device according to the embodiment of the present invention.

To overcome the drawback caused by forming the low voltage differential signal lines 5 in a zigzag pattern, and the drawback in which lowering of the power source voltage and lowering of the differential amplitude arise in the wiring due to large-sizing of the substrate, a level shift circuit 34 is provided to the receiver circuit 31. FIG. 14 shows the receiver circuit 31 provided with the level shift circuit 34. The circuit shown in FIG. 14 includes the level shift circuit 34 for always ensuring a fixed input range in the differential input part 35. The manner of operation of the circuit shown in FIG. 14 will be explained hereinafter. Here, although the circuit shown in FIG. 14 adopts a PMOS inputting method, it is possible to adopt an NMOS inputting method.

Figure 15A:
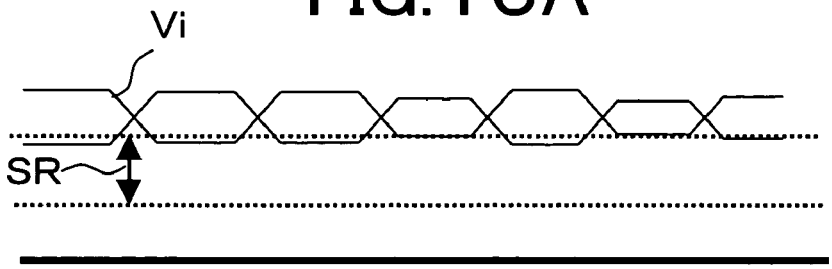
FIGS. 15A and 15B are signal diagrams illustrating the operation of input circuits and FIG. 15C is a schematic diagram of the input circuits of the liquid crystal display device according to the embodiment of the present invention.
Figure 15B:
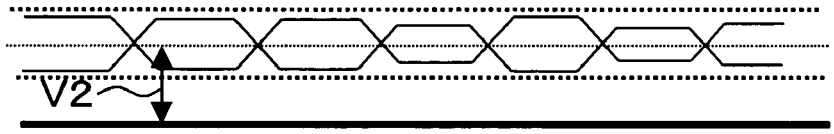
Figure 15C:
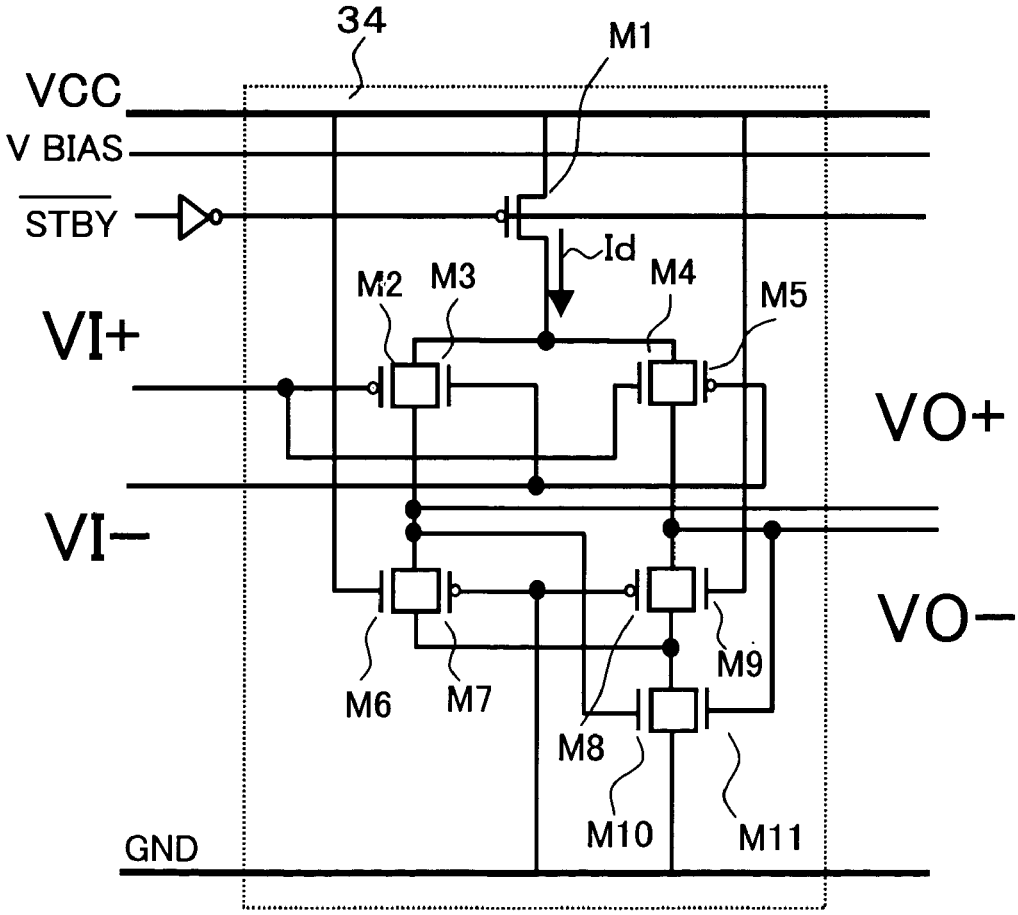

First of all, an explanation will be made with respect to a case in which the input waveform voltage is high with respect to the stable operation range, in conjunction with FIGS. 15A to 15C. As shown in FIG. 15A, the input signal Vi assumes a high voltage with respect to the stable operation range SR. Although the current Id is configured to flow into the transistor M1, when the range of the input signal Vi is high, the PMOS transistors M2, M5 which constitute inputs, assume a substantially cut-off state, and, hence, a current Id3 (a current which flows into the transistor M3) and a current Id4 (a current which flows into the transistor M4) are made to flow in the NMOS transistors M3,M4. Since the transistor M1 operates as a constant-current power source, the current Id becomes Id3+Id4. Here, a voltage VCC is inputted to the gate electrodes of the transistors M6, M9 and a voltage GND is inputted to the gate electrodes of the transistors M7, M8, and, hence, these transistors M6 to M9 are operated as resistances having a fixed resistance value gm. Since the currents Id3, Id4 flow into the resistance having the resistance value gm, differential voltages Vo+, Vo− are generated. Further, the voltages Vo+, Vo− are inputted to gate electrodes of the transistors M10, M11, and the transistors M10, M11 assume a complimentary relationship. Accordingly, the transistors M6 to M10 can generate a fixed offset voltage V2 with respect to the differential input part 35. That is, as shown in FIG. 15A, even when the input signal Vi is inputted so as to exceed the stable operation range SR, it is possible to set the offset voltage V2, which becomes the center of the amplitude, such that the input voltage Vi can have an amplitude within the stable operation range SR due to the level shift circuit 34, as shown in FIG. 15B.

Figure 16A:
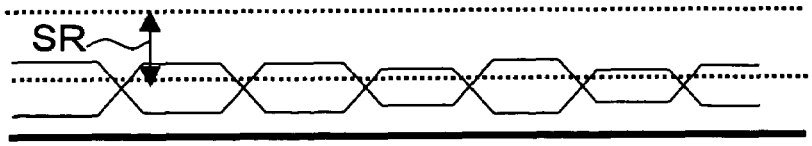
FIGS. 16A and 16B are signal diagrams illustrating the operation of input circuits and FIG. 16C is a schematic diagram of the input circuits of the liquid crystal display device according to the embodiment of the present invention.
Figure 16B:
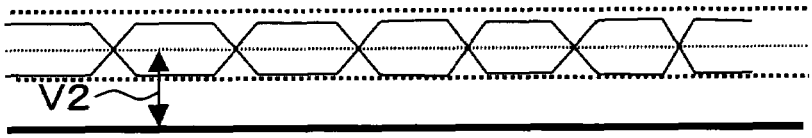
Figure 16C:
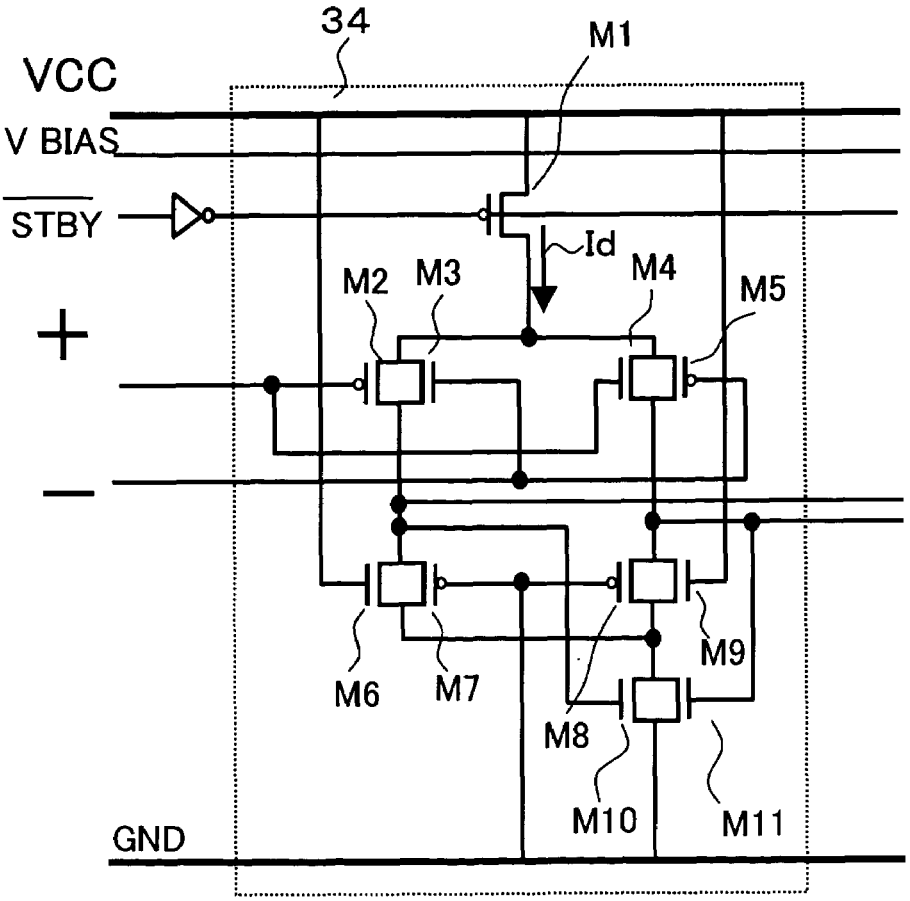

Next, an explanation will be made with respect to a case in which the input waveform voltage is low with respect to the stable operation range, in conjunction with FIGS. 16A to 16C. In FIG. 16C, a current Id also flows into the transistor M1 in the same manner. A voltage V2, which is generated by voltage division using the resistance value gm of the transistors M6 to M10, can assume the same voltage when the input voltage Vi is high. That is, since the differential voltage in a fixed range is always supplied to the differential input part 35, it is possible to realize a receiver circuit 31 which is not influenced by the dynamic range of the differential voltage which constitutes the input.

Provided that the input range of the differential input part 35 is fixed, the inverter input assumes a fixed waveform, and, hence, there is no possibility that the operation point will be displaced. Accordingly, no conversion skews are generated in the receiver circuit 31, and, hence, the liquid crystal display panel can cope with high-speed operation.

Figure 17:
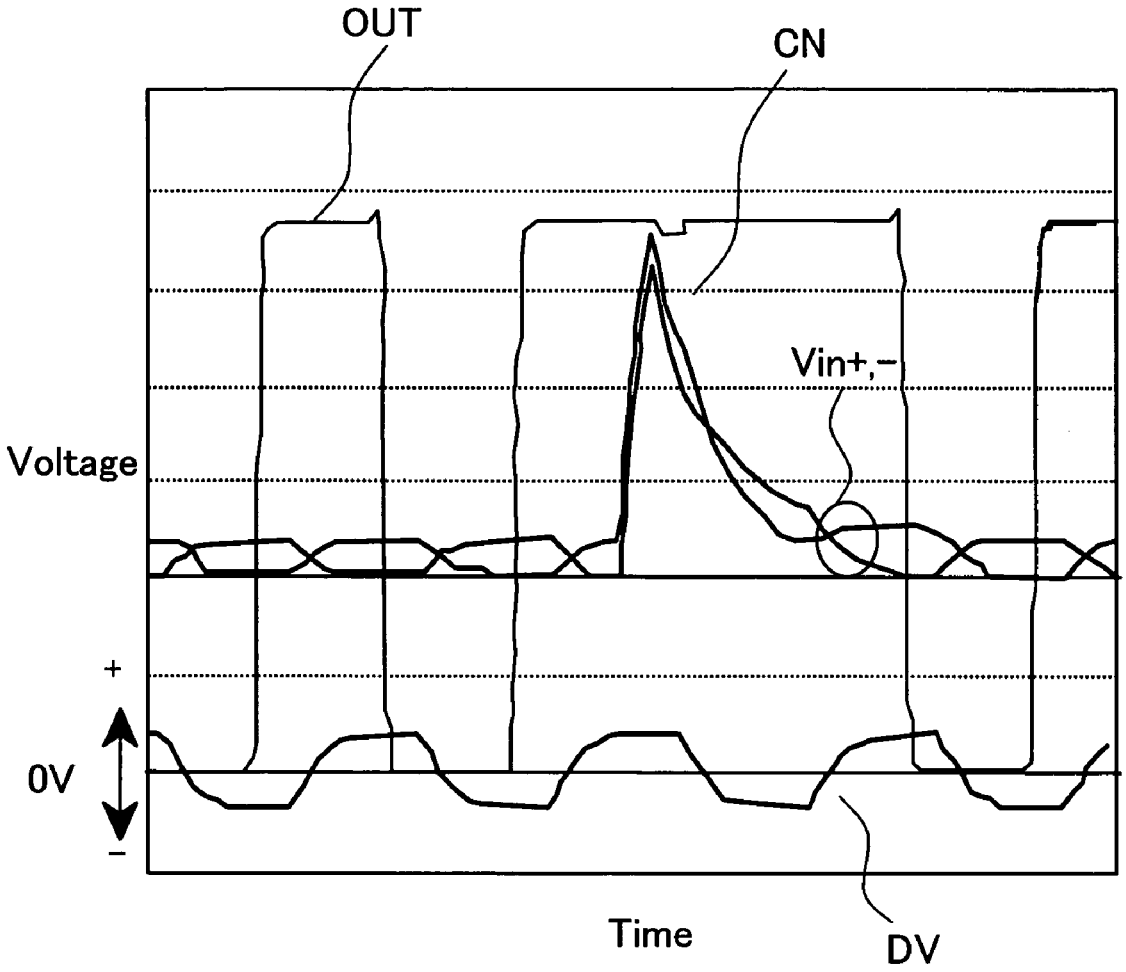
FIG. 17 is a graph showing signal waveforms of the liquid crystal display device according to the embodiment of the present invention.

FIG. 17 shows an example of the operation of the circuit without the level shift circuit 34 when a coupling noise CN infiltrates the differential signals. When the differential voltage DV is inputted, the receiver circuit outputs signals OUT of H, L levels in response to the input. However, the signal OUT exceeds the stable input range of the differential operation, and, hence, even when the differential voltage DV is normal, a portion which receives the coupling noise CN cannot respond in the differential input part. The same goes for the case shown in FIG. 13, in which there exists an offset in the voltage distribution.

Figure 18:
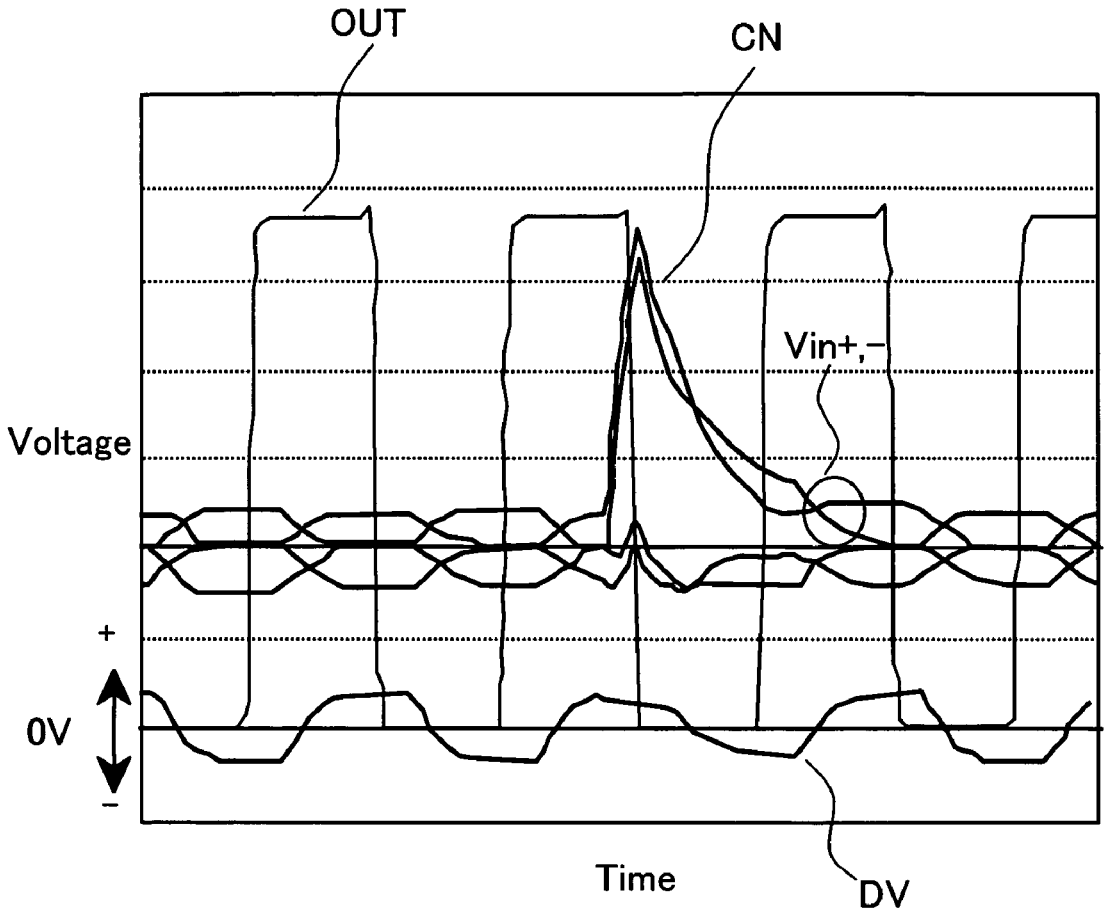
FIG. 18 is a graph showing signal waveforms of the liquid crystal display device according to the embodiment of the present invention.

Next, a case in which the level shift circuit 34 is provided to the receiver circuit is shown in FIG. 18. It can be seen from the drawing that the operation can be performed in a state in which the differential voltage is held at a normal value and the receiver output is also held at a normal value.

Further, the receiver circuit 31 also has a function of reducing the power consumption using a standby signal bar STBY, as shown in FIG. 14. That is, the receiver circuit 31 includes a function in which the current which flows into the transistor MI of the level shifter part 34 is interrupted by the standby signal bar STBY; the switch SW1 is used as an element which is turned off when the standby signal bar STBY assumes a low level, so that a power source bias VBIAS of the differential input part is also interrupted by the switch SW1; a current which flows into the transistor M12 is interrupted by a switch SW3, which is turned on when the standby signal bar STBY assumes a low level; and a high resistance Hiz is set at a stable level by a switch SW2, so as to fix the receiver output, thus reducing the current consumption. Due to such a circuit, the whole circuit by the receiver is cut when not required, and, hence, the current consumption can be reduced, thus contributing to a low power consumption, whereby the operation ratio of the display device is lowered and the reliability is enhanced.

Figure 19:
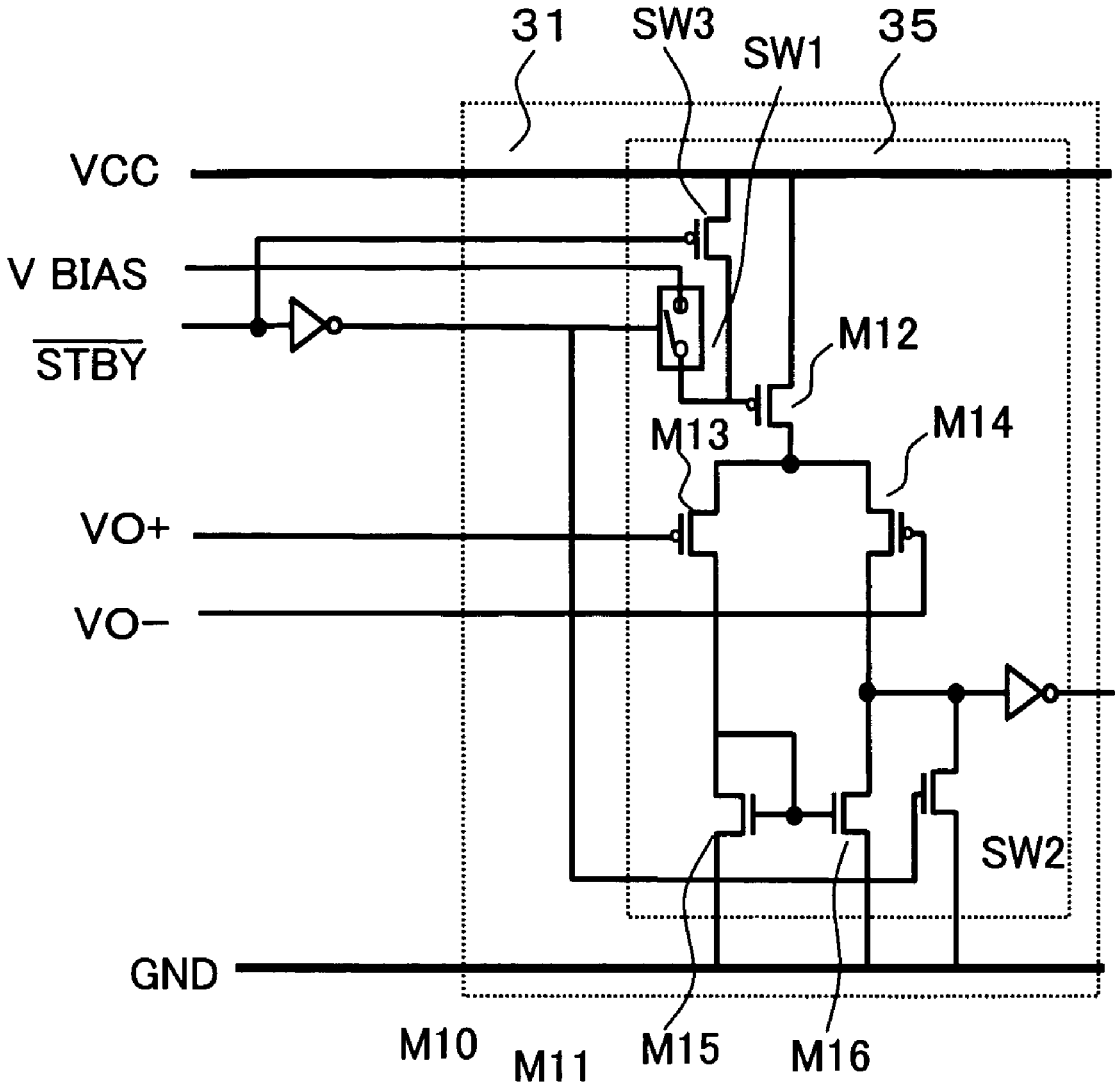
FIG. 19 is a schematic diagram illustrating an input portion of the drive circuit of the liquid crystal display device according to the embodiment of the present invention.

Further, as means for increasing the input dynamic range, as shown in FIG. 19, input-pair transistors M13, M14 of the differential input part may be constituted of a depression MOS transistor. By constituting the input part using a depression MOS transistor, the threshold value voltage can be elevated, and, hence, even when the voltage of the input signal is relatively high, inputting of signals can be performed.

As has been explained heretofore, according to the present invention, it is possible to reduce the influence of noises and, at the same time, it is possible to realize stable high-speed operation by reducing the influence of the power source impedance and the wiring resistance. Further, a low power consumption can be realized by the standby function. Accordingly, a driver in which the reliability with respect to noises and the lifetime is enhanced and a liquid crystal display device which mounts the driver can be realized.

What is claimed is:

1. A display device comprising:

a display panel;

a plurality of drive circuits which drive the display panel; and a plurality of low voltage differential signal lines which supply low voltage differential signals to the drive circuits, wherein:

the drive circuit includes an input circuit to which the low voltage differential signals are inputted, the low voltage differential signal lines are formed in a zigzag pattern to overlap the drive circuits, the input circuit includes a level shift circuit and a differential input circuit, the level shift circuit changes a voltage level of the low voltage differential signals and outputs an output low voltage differential signal to the differential input circuit within a stable operation range, the level shift circuit includes a constant-current power source transistor, a first input terminal, a second input terminal, a first output terminal, and a second output terminal, the constant-current power source transistor electrically disconnects from a power source line based on a standby signal, and the level shift circuit receives one pair of the low voltage differential signals through the first input terminal and the second input terminal, respectively, the level shift circuit outputs one pair of the output low voltage differential signals to the first output terminal and second output terminal, respectively, and when the low voltage differential signals exceed the stable operation range, the level shift circuit generates a fixed offset voltage, which becomes a center of the amplitudes of the output low voltage differential signals.

2. A display device according to claim 1, further comprising connection terminals formed on the drive circuits to which the low voltage differential signals are inputted, wherein the connection terminals include function changing input terminals which change functions of the connection terminals.

3. A display device comprising:

a display panel;

a plurality of drive circuits which drive the display panel; and a plurality of low voltage differential signal lines which supply low voltage differential signals to the drive circuits, wherein:

the drive circuit includes an input circuit to which the low voltage differential signals are inputted and an output circuit which outputs gray scale voltages, the low voltage differential signal lines are formed in a zigzag pattern to overlap the drive circuits, the input circuit includes a level shift circuit and a differential input circuit, the level shift circuit shifts a voltage level of the low voltage differential signals into a stable operation range and outputs an output low voltage differential signal to the differential input circuit, the level shift circuit includes a constant-current power source transistor, a first input terminal, a second input terminal, a first output terminal, and second output terminal, the constant-current power source transistor electrically disconnects from a power source line based on a standby signal, the level shift circuit receives one pair of the low voltage differential signals from the first input terminal and second input terminal, respectively, the level shift circuit outputs one pair of the output low voltage differential signals to the first output terminal and second output terminal, respectively, and when the low voltage differential signals exceed the stable operation range, the level shift circuit generates a fixed offset voltage, which becomes a center of the amplitudes of the output low voltage differential signals.

4. A display device according to claim 3, further comprising connection terminals formed on the drive circuits to which the low voltage differential signals are inputted, wherein the connection terminals include function changing input terminals which change functions of the connection terminals.

5. A display device comprising:

a display panel;

a plurality of drive circuits which drive the display panel; and a plurality of low voltage differential signal lines which supply low voltage differential signals to the drive circuits, wherein:

the drive circuit includes an input circuit which is connected to the lines and to which the low voltage differential signals are inputted and an output circuit which outputs gray scale voltages to the display panel, the low voltage differential signal lines are formed in a zigzag pattern to overlap the drive circuits, the input circuit includes a differential circuit which outputs a high-level voltage and a low-level voltage from the low voltage differential signals and a level shift circuit which is operated to make the low voltage differential signals assume a stable operation level of the differential circuit, the level shift circuit outputs an output low voltage differential signal to the differential circuit, the level shift circuit includes a constant-current power source transistor, a first input terminal, a second input terminal, a first output terminal, and second output terminal, the constant-current power source transistor electrically disconnects from a power source line based on a standby signal, and the level shift circuit receives one pair of the low voltage differential signals from the first input terminal and second input terminal, respectively, the level shift circuit outputs one pair of the output low voltage differential signals to the first output terminal and second output terminal, respectively, and when the low voltage differential signals exceed the stable operation range, the level shift circuit generates a fixed offset voltage, which becomes a center of the amplitudes of the output low voltage differential signals.

6. A display device according to claim 5, further comprising connection terminals formed on the drive circuits to which the low voltage differential signals are inputted, wherein the connection terminals include function changing input terminals which change functions of the connection terminals.

7. A display device according to claim 5, wherein the differential circuit includes an input part and the input part includes depression type MOS transistors.

* * * * *